US011698073B2

(12) United States Patent
Hohn et al.

(10) Patent No.: US 11,698,073 B2
(45) Date of Patent: Jul. 11, 2023

(54) SWIMMING POOL AND SPA PUMPS CONFIGURED TO IMPROVE PRIMING PERFORMANCE

(71) Applicant: ZODIAC POOL SYSTEMS LLC, Carlsbad, CA (US)

(72) Inventors: James Hohn, Oceanside, CA (US); Richard Asplund, Vista, CA (US)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 0 days.

(21) Appl. No.: 17/201,351

(22) Filed: Mar. 15, 2021

(65) Prior Publication Data

US 2021/0310490 A1 Oct. 7, 2021

Related U.S. Application Data

(60) Provisional application No. 63/004,869, filed on Apr. 3, 2020.

(51) Int. Cl.
*F04D 9/00* (2006.01)
*F04D 29/44* (2006.01)

(52) U.S. Cl.
CPC ..... *F04D 9/004* (2013.01); *F04D 29/448* (2013.01)

(58) Field of Classification Search
CPC .... F04D 9/004; F04D 29/4293; F04D 29/445; F04D 29/448
See application file for complete search history.

(56) References Cited

U.S. PATENT DOCUMENTS 2,934,021 A * 4/1960 Conery ..... F04D 9/06 415/121.2
3,103,177 A * 9/1963 Gatto ..... F04D 9/02 415/56.3

(Continued)

FOREIGN PATENT DOCUMENTS

EP 0460597 12/1991
WO 9823864 6/1998

(Continued)

OTHER PUBLICATIONS

International Application No. PCT/US2021/022323, International Search Report and Written Opinion dated Jun. 30, 2021, 11 pages.

(Continued)

*Primary Examiner* — David E Sosnowski
*Assistant Examiner* — Jason G Davis
(74) *Attorney, Agent, or Firm* — Kilpatrick Townsend & Stockton LLP

(57) ABSTRACT

Disclosed are pumps designed to make priming more efficient and therefore reduce priming time. The disclosed pumps include one or more deflection structures that prevent fluid moving through a diffuser of the pump from continuing in a circular path and instead divert the fluid in a different direction that leads directly to an outlet of the pump. This deflection reduces air bubble accumulation inside the pump while priming and makes it easier for air to escape through the pump outlet. Making it easier for air to escape the pump outlet ultimately allows air to escape the pump faster during priming, reducing back pressure caused by trapped air pockets inside the pump and improving priming performance.

23 Claims, 32 Drawing Sheets

(56) References Cited

U.S. PATENT DOCUMENTS 5,100,289 A * 3/1992 Caoduro ..... F04D 9/06
415/206
5,226,790 A * 7/1993 Serafin ..... F04D 9/005
415/182.1

FOREIGN PATENT DOCUMENTS

WO 0068575 11/2000
WO WO-03056185 A1 * 7/2003 ..... F04D 29/426

OTHER PUBLICATIONS

International Application No. PCT/US2021/022323, International Preliminary Report on Patentability dated Oct. 13, 2022, 7 pages.

* cited by examiner

SWIMMING POOL AND SPA PUMPS CONFIGURED TO IMPROVE PRIMING PERFORMANCE

CROSS-REFERENCE TO RELATED APPLICATION

This application claims the benefit of and priority to U.S. Provisional Patent application Ser. No. 63/004,869, filed Apr. 3, 2020, the entire contents of which are hereby incorporated herein by this reference.

FIELD OF THE INVENTION

This invention relates to pumps for moving fluid and particularly, but not necessarily exclusively, to centrifugal pumps used in swimming pools and spas.

BACKGROUND OF THE INVENTION

Most centrifugal pumps require priming before use, or the pump will not function properly or at all. Such pumps have difficulty priming to certain heights—such as above around 5 feet—in short amounts of time. Larger pumps designed for commercial applications have even greater difficulty priming, with average priming times ranging anywhere from 25 minutes to more than an hour. Down time spent priming the pump can be costly to commercial and other facilities, as swimming pools and spas are rendered inoperable while the pump is priming.

SUMMARY OF THE INVENTION

The present invention provides alternative pump designs that make priming more efficient and therefore dramatically reduce priming time. The disclosed pumps include one or more deflection structures that deflect the fluid from the diffuser directly toward the outlet of the pump. In particular, the one or more deflection structures force the fluid flow from a circular path and direct it to the pump outlet. In some instances, the one or more deflection structures change the circular flow path around the diffuser to an axial path toward the pump outlet. In some examples, when the pump outlet is within a plane that is offset from a plane of the diffuser, the one or more deflection structures deflect the fluid approximately 90 degrees (or other suitable angle) so the fluid flows in an axial (e.g., lateral) direction perpendicular to its otherwise circular flow.

This deflection forces the fluid flow from its circular path directly toward the pump outlet, reducing air bubble accumulation inside the pump while priming and making it easier for air to escape through the pump outlet. Making it easier for air to escape the pump outlet ultimately allows air to escape the pump faster during priming, reducing back pressure caused by trapped air pockets inside the pump and drastically improving priming performance. The deflection structures can take many forms, including separation petitions, ramps, projections, fins, spiraled/twisted/curved surfaces, etc.

It thus is an optional, non-exclusive object of the invention to provide designs for pumps.

It is another optional, non-exclusive object of the present invention to provide pumps with improved priming performance.

It is another optional, non-exclusive object of the present invention to provide pumps with improved hydraulic efficiencies.

It is also an optional, non-exclusive object of the present invention to provide pumps configured to separate fluid flowing through the diffuser and deflect at least a portion of the fluid from its circular flow toward an outlet of the pump.

It is a further optional, non-exclusive object of the present invention to provide pumps especially useful in connection with water-circulation systems of swimming pools and spas.

Other objects, features, and advantages of the present invention will be apparent to those skilled in the relevant art with reference to the remaining text and the drawings of this application.

DETAILED DESCRIPTION

Figure 1:
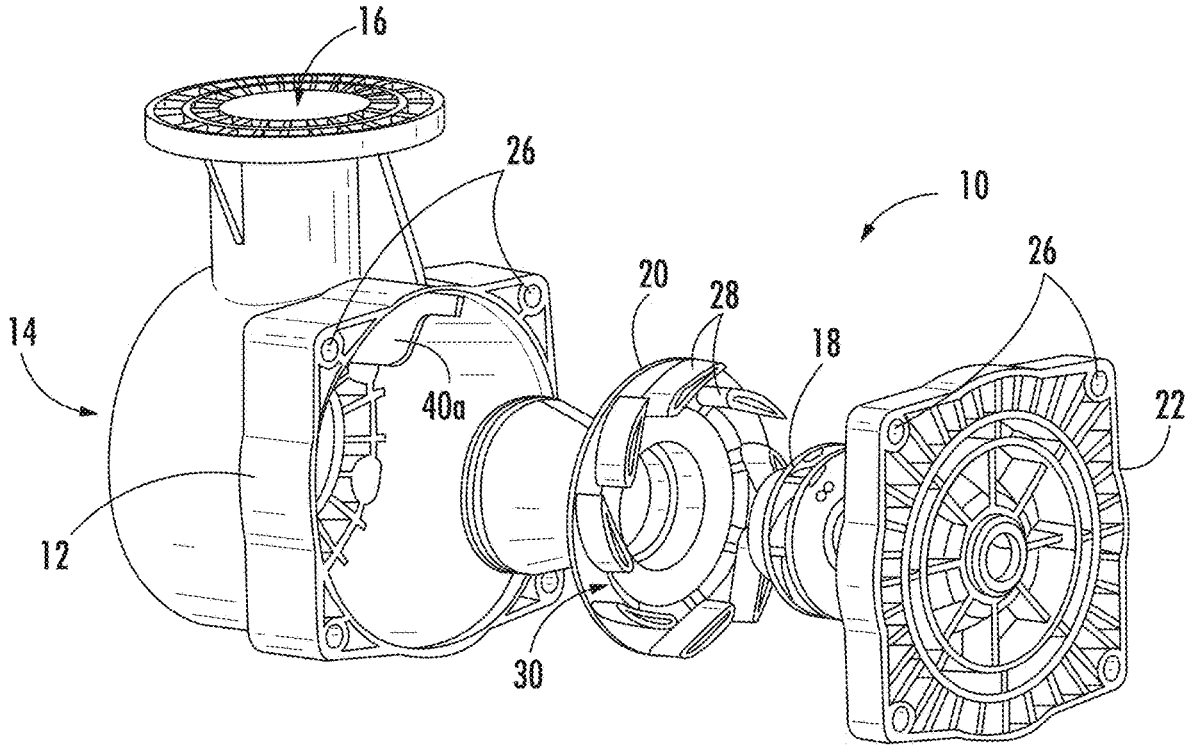
FIG. 1 is an exploded view of an exemplary pump of the present invention.
Figure 2:
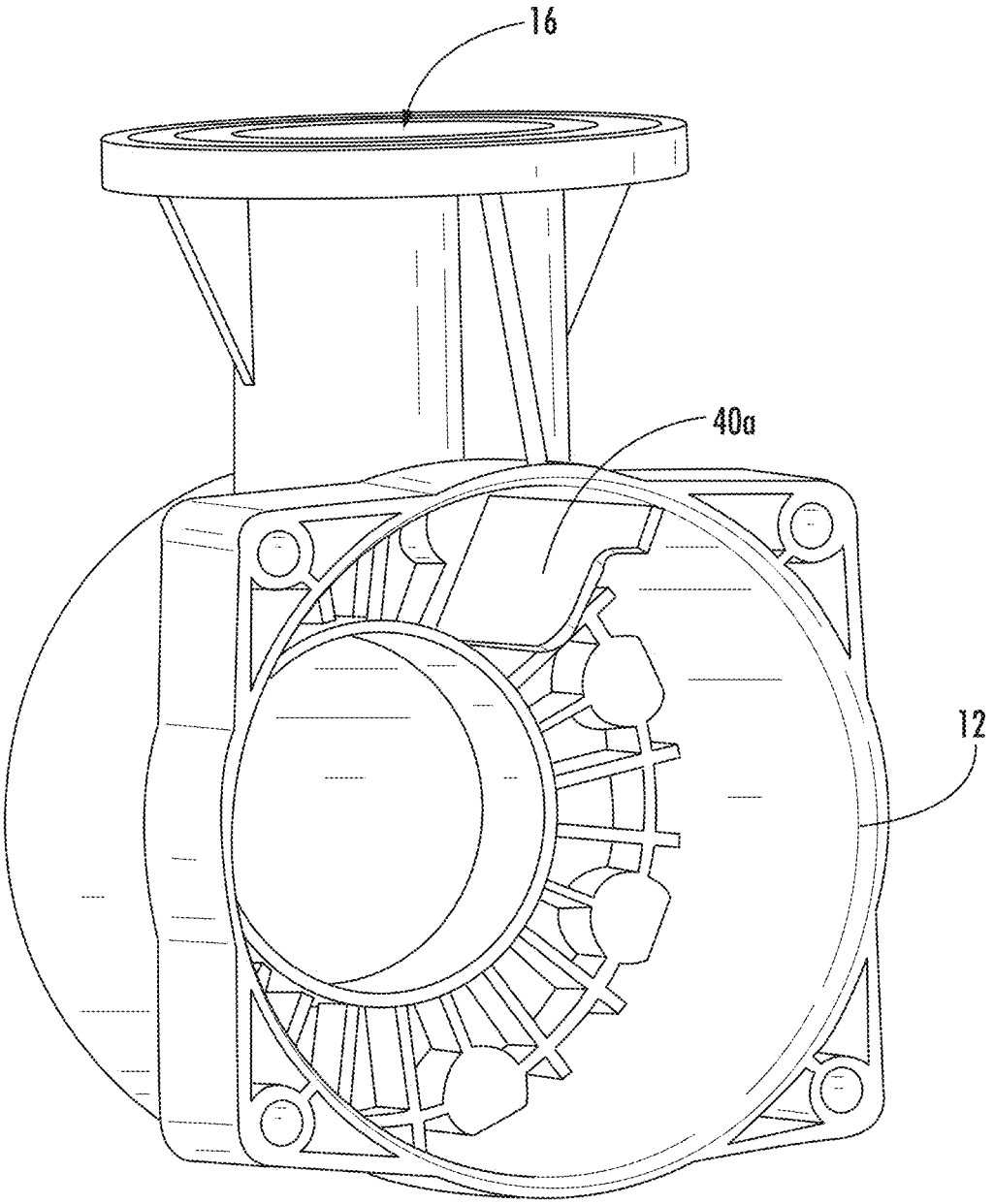
FIG. 2 is a perspective view of the housing of the pump of FIG. 1.
Figure 12:
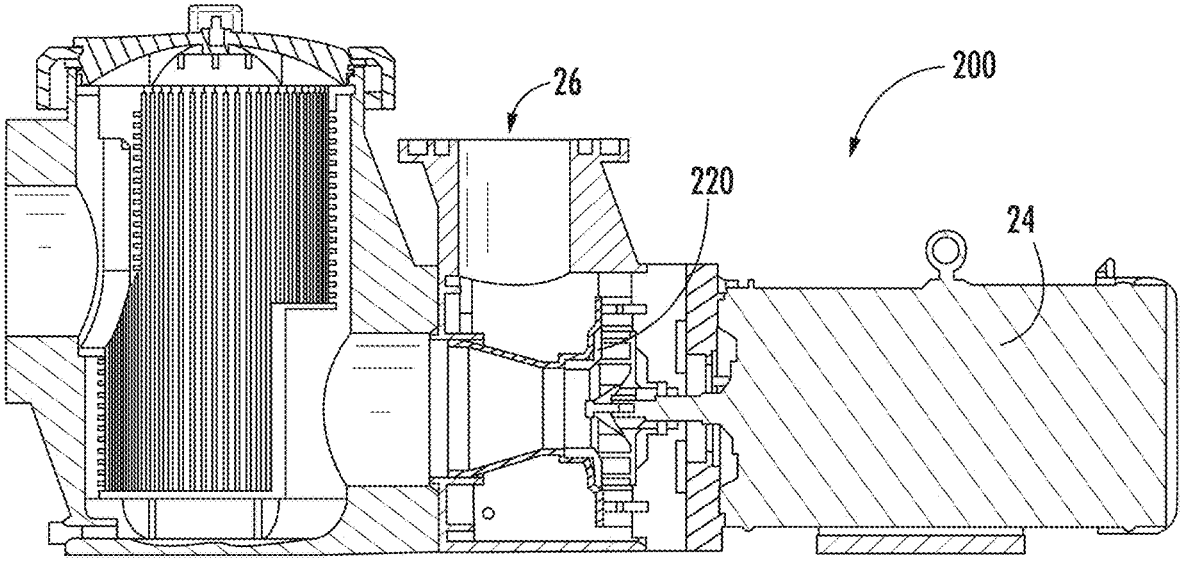
FIG. 12 is a cross-sectional view of the pump of FIG. 11, shown coupled to a motor and a strainer basket.

Illustrated in FIGS. 1-5 is an exemplary pump 10 according to an embodiment of the present invention. Pump 10 includes a pump housing 12, a pump inlet 14, and a pump outlet 16. Pump 10 also includes an impeller 18 and a diffuser 20. Although pump 10 shown in FIG. 1 is a single-stage pump, the pumps disclosed herein can have any number of stages (e.g., include more than one impeller and diffuser). Pump 10 may include a seal plate 22 that couples with the pump housing 12 (such as through fasteners received within apertures 26) to house the impeller 18 and the diffuser 20. Operation of a motor 24 (see FIG. 12) rotates the impeller 18 to fling water or other fluid received from the pump inlet 14 radially to the diffuser 20.

Figure 3:
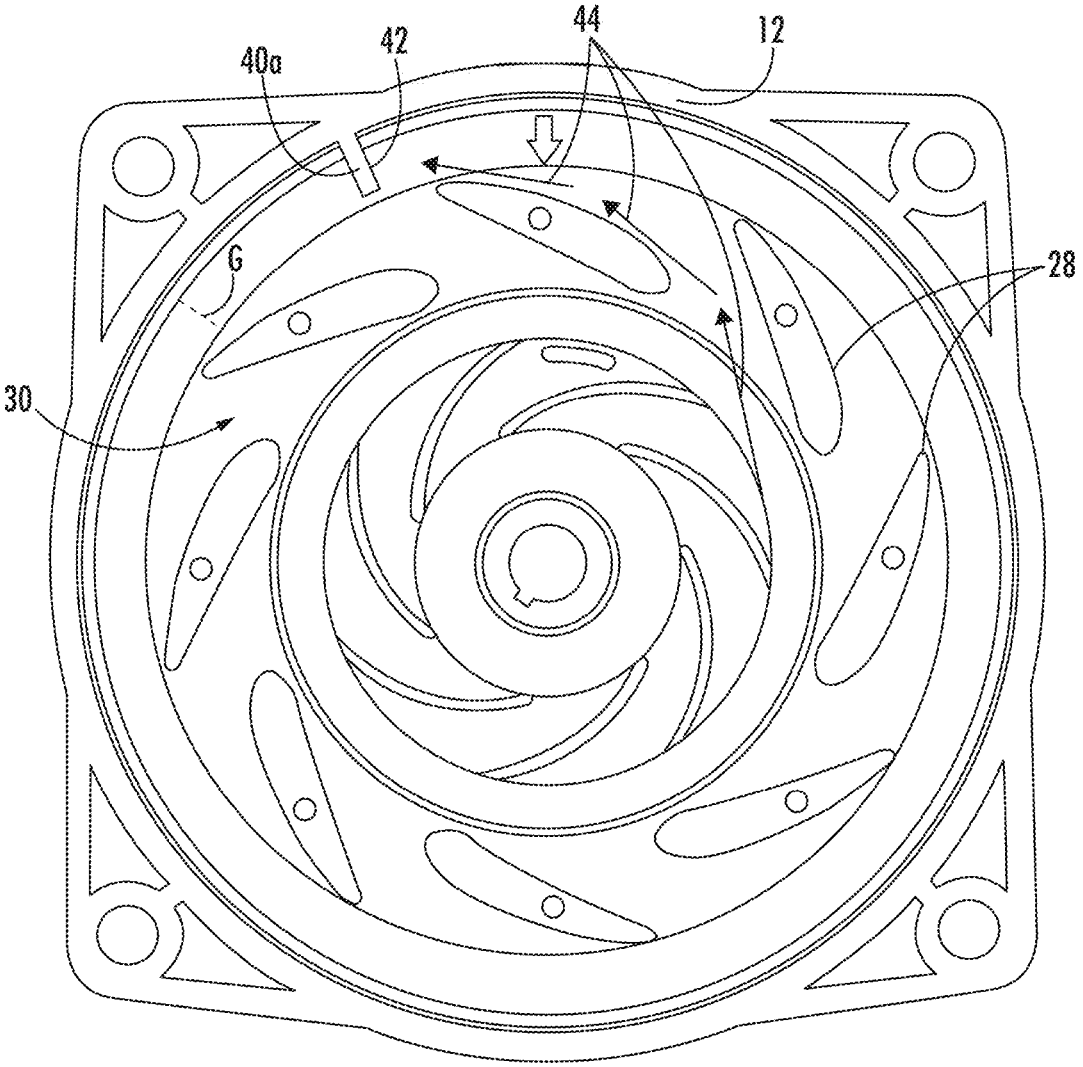
FIG. 3 is a front, cut-away view of aspects of the pump of FIG. 1.

As shown in FIGS. 1 and 3, the diffuser 20 includes a number of vanes 28 that surround the impeller 18. Through the arrangement of the vanes 28, the diffuser 20 increases the flow area of the fluid (such as water and/or air) as it passes through channels 30 formed by the vanes 28 of the diffuser 20, reducing the absolute velocity of the fluid and transforming the fluid energy into pressure. As it passes through the diffuser 20, the fluid (e.g., water and/or air) is directed by centrifugal force in a circular flow through a gap G (see, for example, FIG. 3) between the inner diameter of the pump housing 12 and the outer diameter of the diffuser 20.

The pump 10 also includes one or more deflection structures 40. These deflection structures 40 can take many forms and are configured to interrupt the circular flow of the fluid and change the direction of the fluid so the fluid quickly exits the diffuser 20 and moves toward the pump outlet 16 (instead of re-circulating within the gap G of the diffuser 20 until enough fluid eventually accumulates in the vanes 28 to force a portion out of the diffuser 20). More specifically, the deflection structures 40 are designed to redirect the fluid flow from the gap G toward the pump outlet 16. In some non-limiting examples, the deflection structures 40 are designed to alter the fluid flow of the diffuser 20 to an axial direction generally perpendicular to the circular flow.

Figure 4:
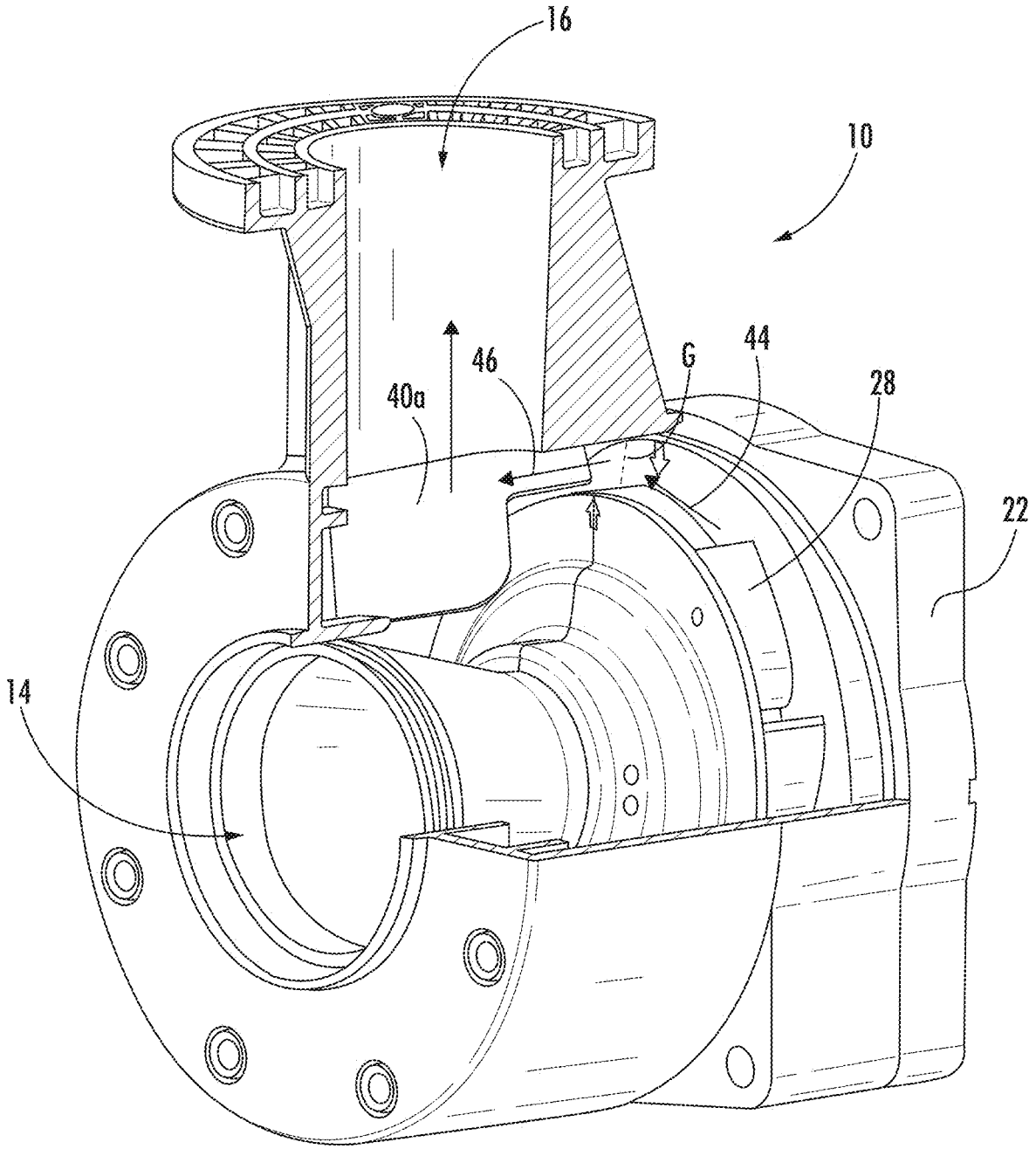
FIG. 4 is a perspective, cut-away view of the pump of FIG. 1.
Figure 5:
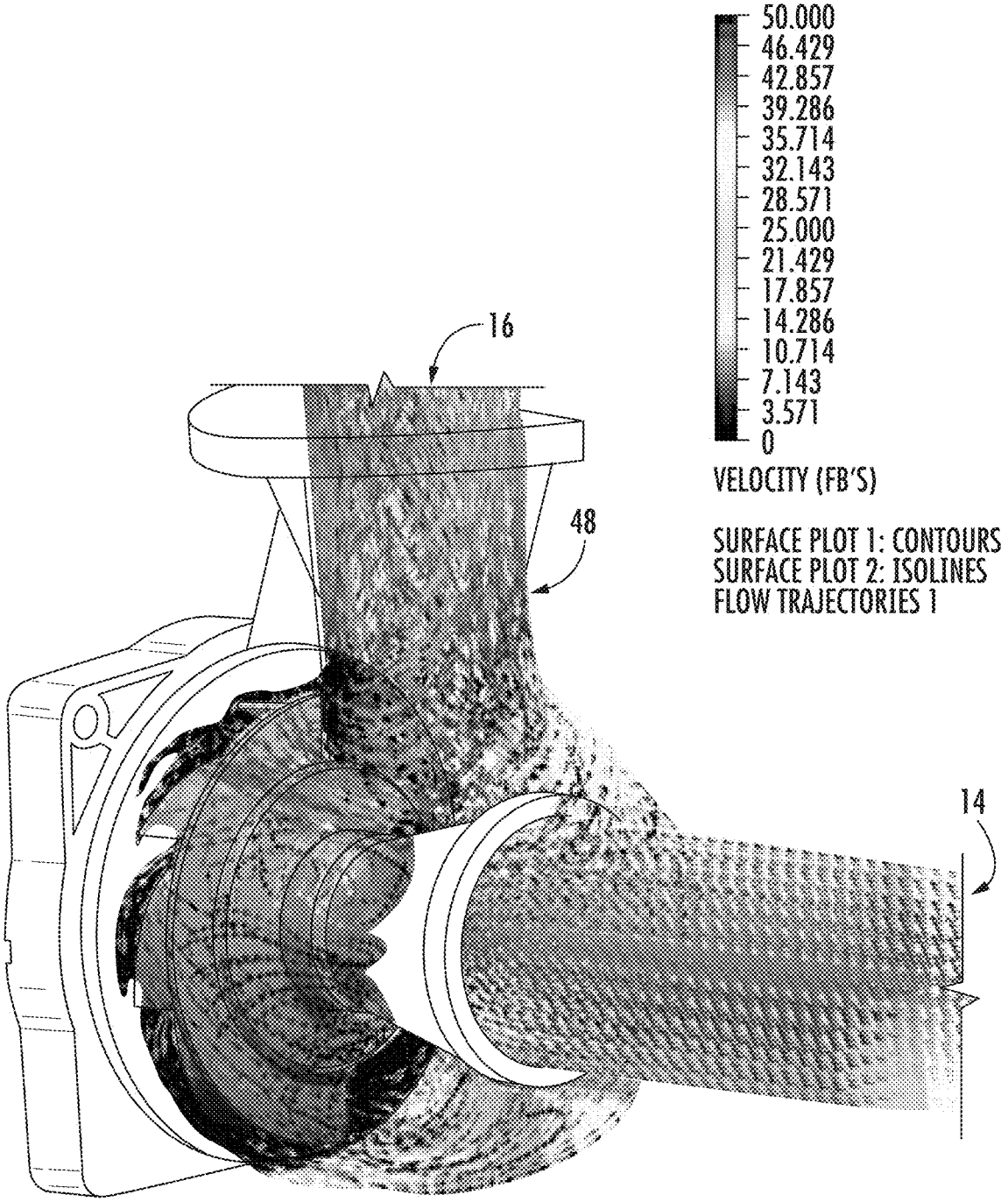
FIG. 5 is a perspective view of simulation of fluid flow through the pump of FIG. 1.
Figure 6:
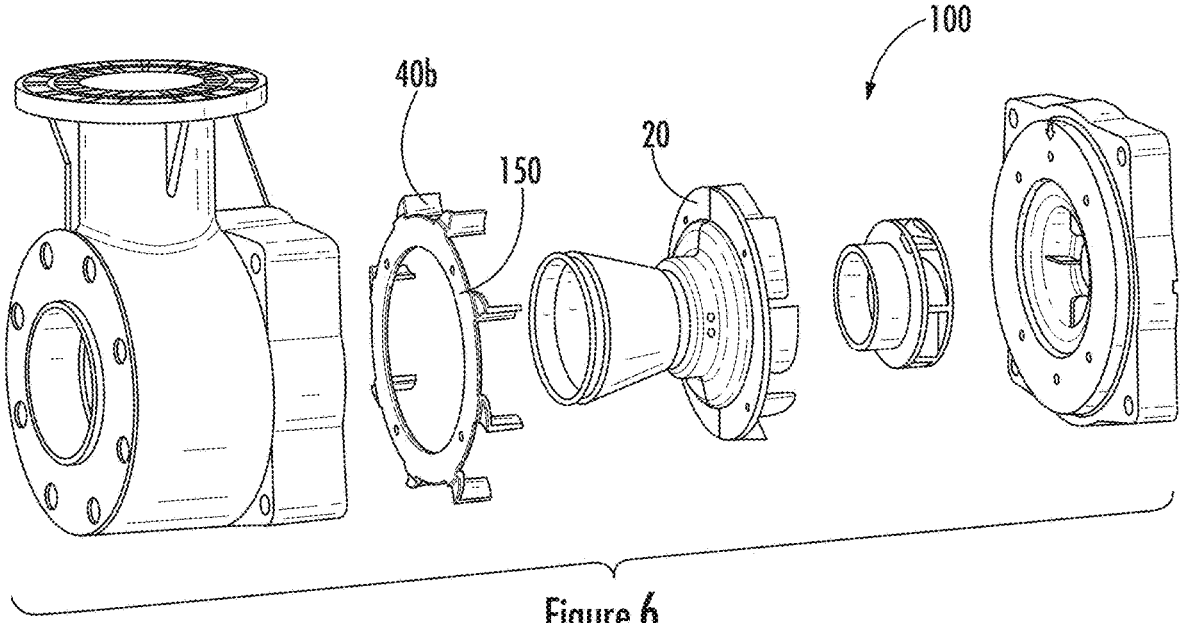
FIG. 6 is an exploded view of another exemplary pump of the present invention.
Figure 7:
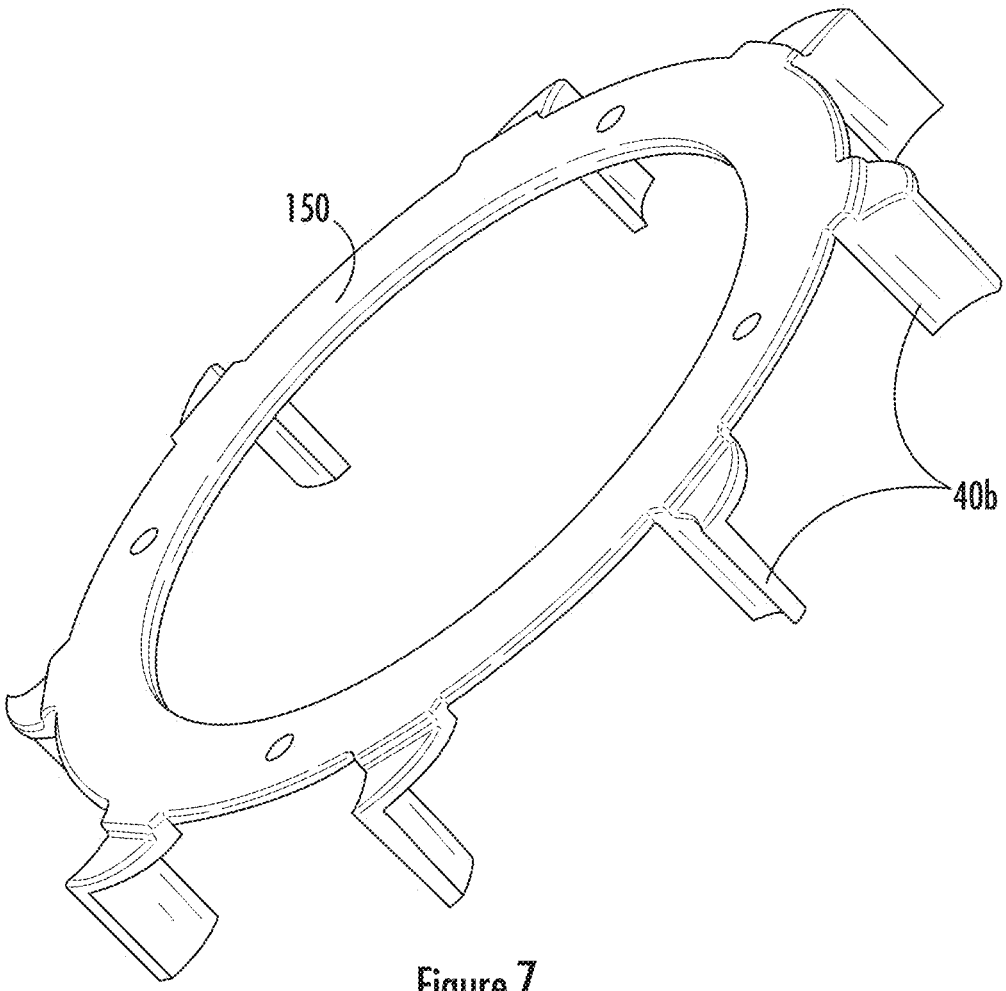
FIG. 7 is a perspective view of a ring of the pump of FIG. 6.
Figure 8:
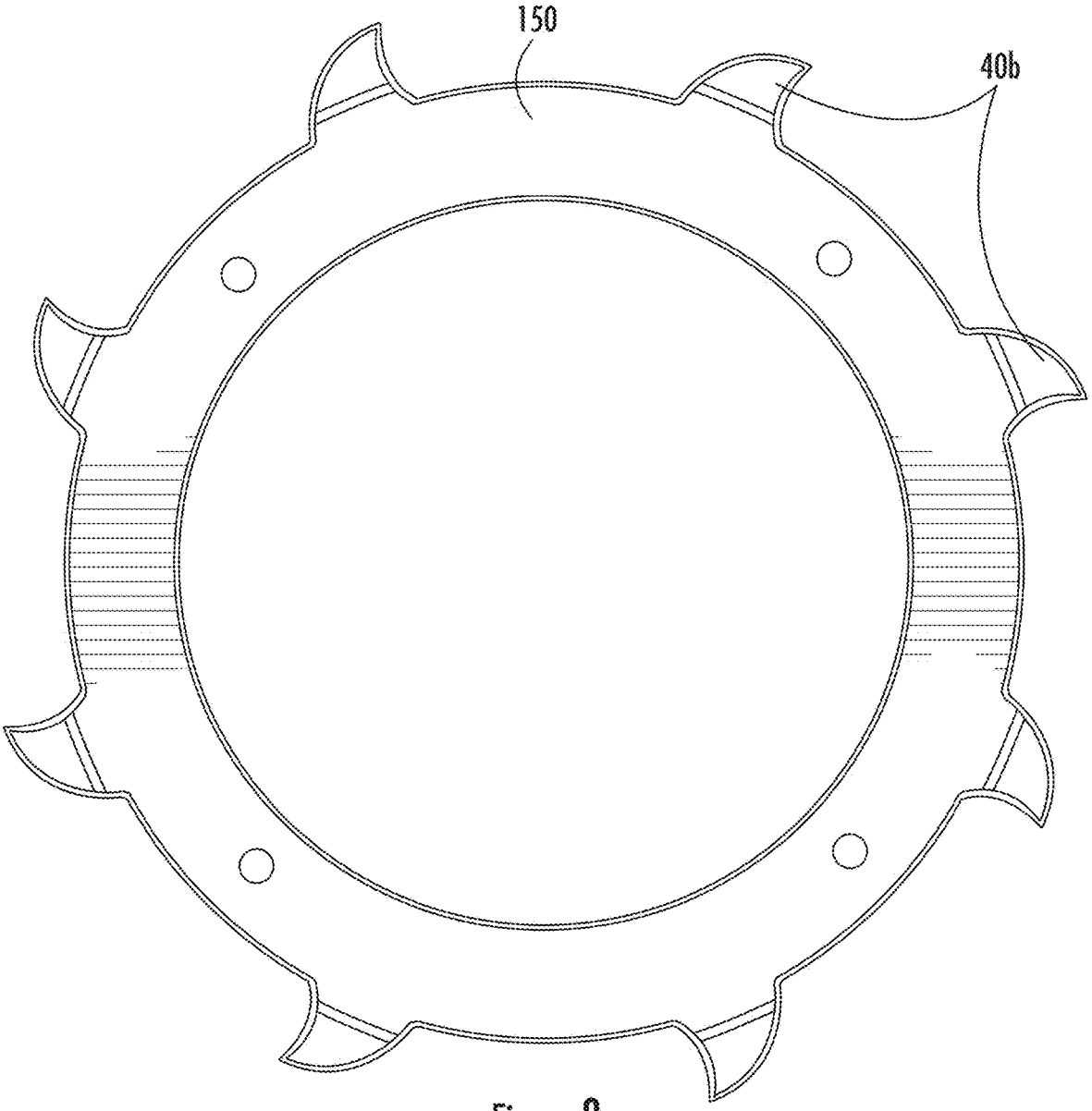
FIG. 8 is a front view of the ring of FIG. 7.
Figure 9:
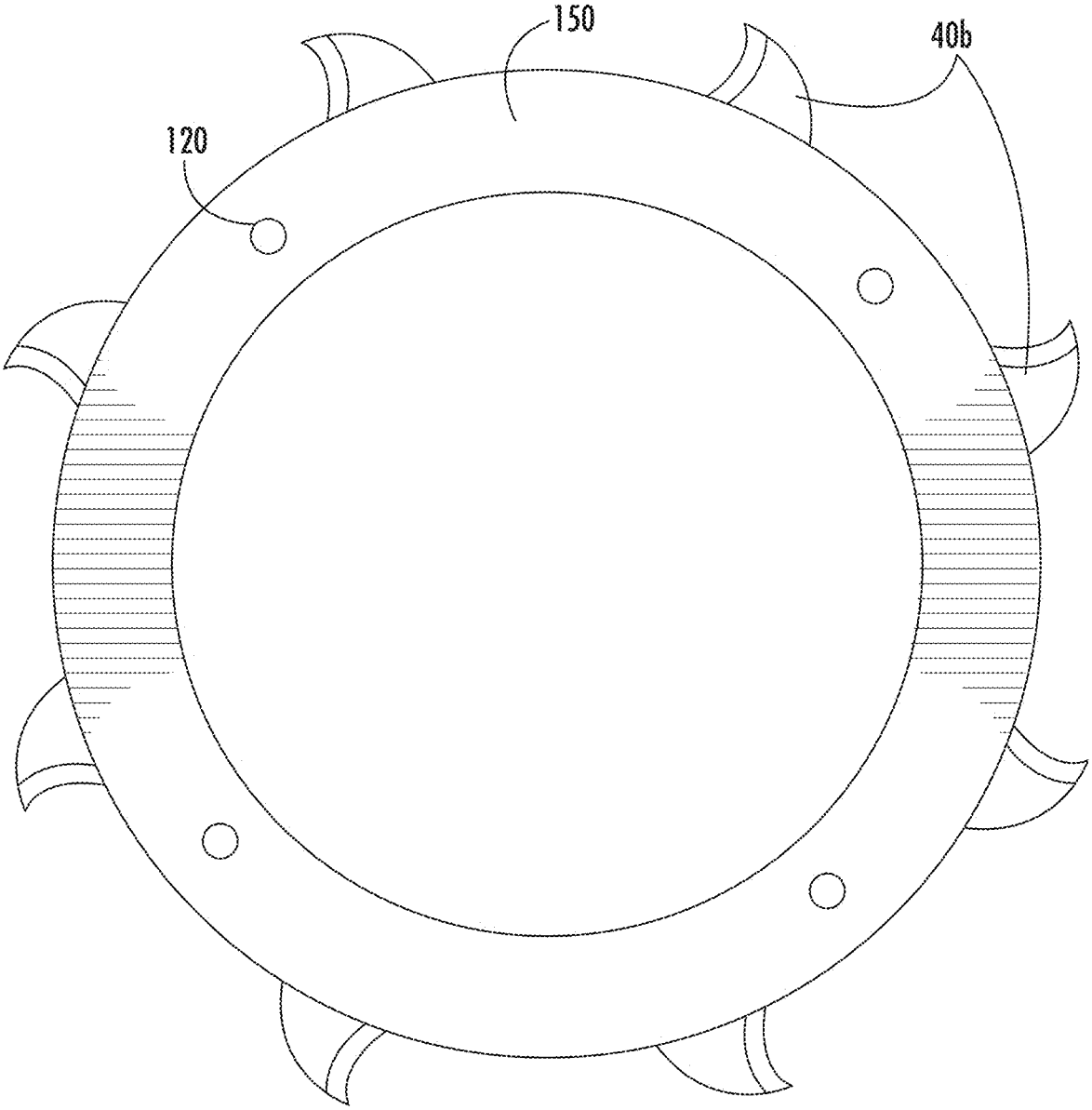
FIG. 9 is a rear view of the ring of FIG. 7.

As shown in FIGS. 3-4, the one or more deflection structures 40 extends at least partially (and in some cases, substantially or completely) into the gap G so fluid moving in a circular path along the gap G encounters the one or more deflection structures 40 and changes direction. In this way, the one or more deflection structures 40 serve as blockers that prevent the fluid from continuing in a circular path through the gap G. Instead, after encountering the one or more deflection structures 40, the fluid exits the diffuser 20 and moves to the pump outlet 16 much more quickly than it would have if the deflection surfaces 40 were not present.

Directing the fluid to the pump outlet 16 before it can recirculate within the diffuser 20 reduces air bubble accumulation inside the pump 10 while priming, making it easier for air to escape from the pump outlet 16. This in turn allows air to escape the pump outlet 16 faster during priming, reducing back pressure caused by trapped air pockets during priming and dramatically improving the priming performance of the pump 10. The arrangement of the deflection structures 40 can also lead to improved hydraulic efficiencies.

This disclosure will provide a number of examples of suitable deflection structures 40, but this disclosure should not be considered limiting, as the deflection structures can take any suitable form. Any number and/or combination of deflection structures may be used, including one or more such structures. The structures may be present on any surface of the pump 10, including, but not limited to, an internal wall (e.g., the inner diameter) of the pump housing 12, the diffuser 20, an internal wall of the seal plate 22, a separate structure such as a ring, and/or other surfaces or components of the pump 10.

FIGS. 1-4 show one non-limiting example of a deflection structure 40*a*. The deflection structure 40*a* is configured as a rib and is arranged axially along an internal wall (e.g., along an inner diameter) of the pump housing 12. The deflection structure 40*a* projects into the gap G between the outer diameter of the diffuser 20 and the inner diameter of the pump housing 12. The deflection structure 40*a* can extend partially or completely into the gap G. The profile/shape/dimensions of the deflection structure 40*a* can be modified as desired. In the non-limiting example of FIGS. 1-4, the deflection structure 40*a* extends in an axial direction (e.g., in a generally horizontal direction when looking at FIG. 4) past the diffusion channels 30 away from the housing 12 and toward the seal plate 22. The deflection structure 40*a* can be placed anywhere radially inside the pump 10, and more than one deflection structure 40*a* may be used. In some examples, as shown in FIG. 4, the deflection structure 40*a* extends axially along the inside of the pump 10 so it nearly touches the seal plate 22, although it need not, so long as the deflection structure 40*a* extends into or past a plane intersecting the vanes 28 of the diffuser 20 such that fluid moving through the diffuser 20 contacts the deflection structure 40*a*.

As mentioned above and shown in FIG. 4, the deflection structure 40*a* extends (e.g., a generally vertical direction when looking at FIG. 4) nearly completely through the gap G formed between the outer diameter of the diffuser 20 and an inner diameter/internal wall of the pump housing 12, ensuring that fluid flowing in a circular path (represented by arrows 44 in FIGS. 3-4) through the gap G of the diffuser 20 contacts the deflection structure 40*a*.

Once fluid flowing within the gap G encounters a face 42 of the deflection structure 40*a*, the fluid is deflected from its circular path 44 to a deflected path (represented by arrow 46 in FIG. 4) leading to the pump outlet 16. In this way, the deflection structure 40*a* acts as a wall to prevent the fluid from continuing in its circular path and instead deflect the fluid into an axial path that leads directly to the pump outlet 16. The walls of the pump housing 12 act as further flow deflectors to deflect the remainder of the fluid flow from the otherwise circular flow. In the embodiment of FIG. 4, a plane containing the longitudinal axis of the pump outlet 16 is offset from a plane containing the longitudinal axis of the diffuser 20. Therefore, in this non-limiting example, the fluid contacting the deflection structure 40*a* is deflected approximately 90 degrees from the circular path 44 into the axial path 46 in FIG. 4 leading directly to the pump outlet 16. In some examples, the deflection structure 40*a* forces the fluid into a helical shape 48, as shown in green in FIG. 5.

Figure 10:
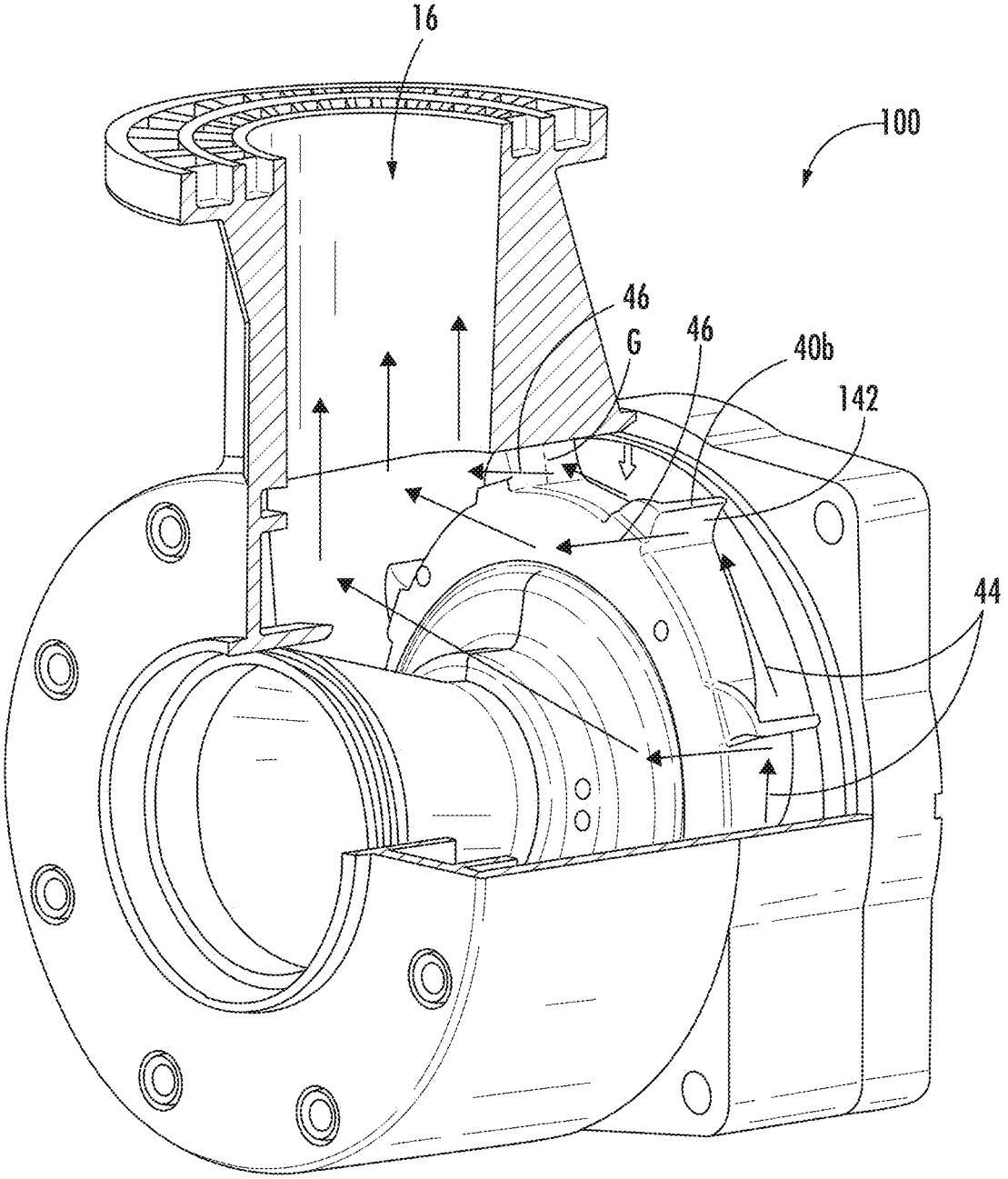
FIG. 10 is a perspective, cut-away view of aspects of the pump of FIG. 6.
Figure 11:
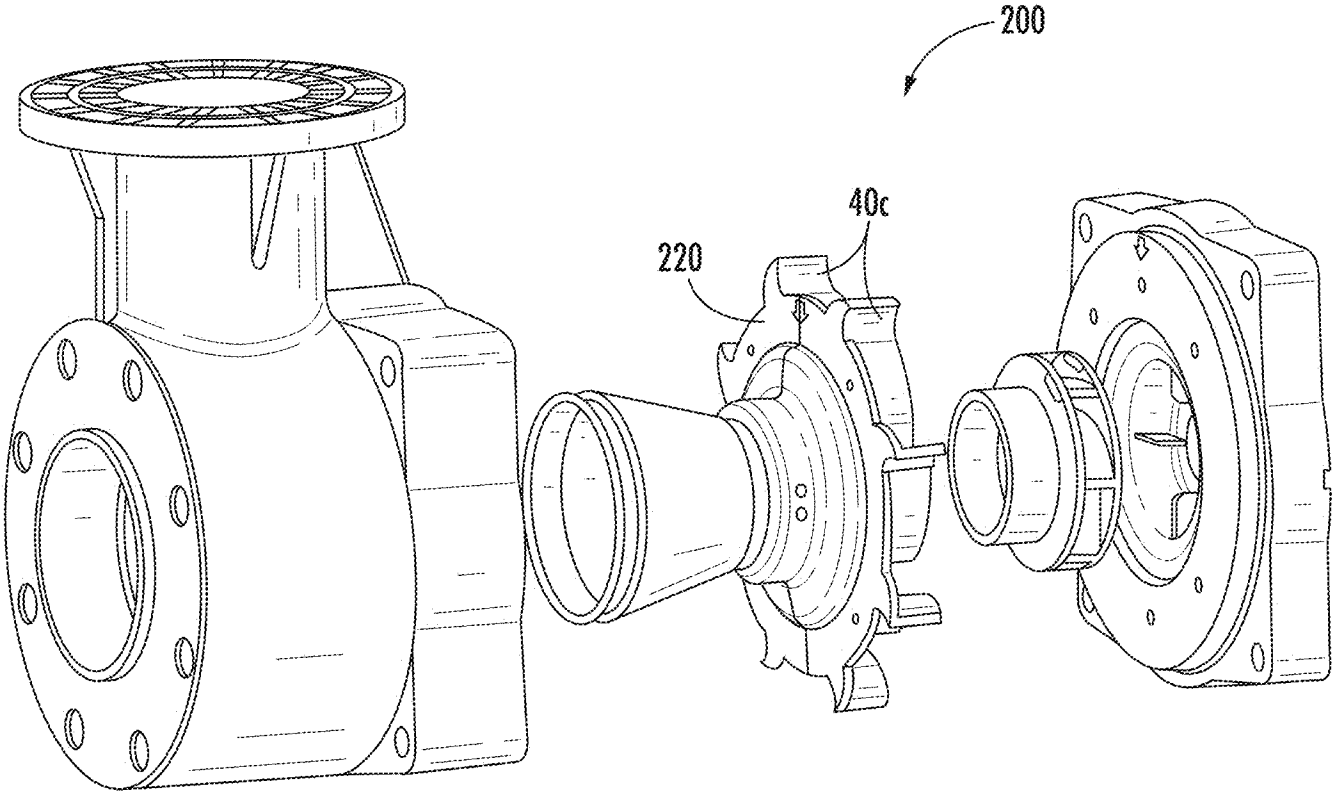
FIG. 11 is an exploded view of another exemplary pump of the present invention.

FIGS. 6-10 show another example of a pump 100 having a plurality of deflection structures. Pump 100 is similar to pump 10 described above, except the deflection structures are provided on a separate component. More specifically, the pump 100 includes a ring 150 having a plurality of deflection structures 40*b*. The ring 150 can be assembled against the diffuser 20, such as through fasteners inserted through apertures 120 (FIG. 9) and corresponding apertures of the diffuser 20. Like the deflection structure 40*a*, the deflection structures 40*b* are configured to prevent the fluid moving through the diffuser 20 from continuing along its circular path in the gap G and instead divert the fluid to an axial path leading to the pump outlet 16. As shown in FIG. 10, the deflection structures 40*b* extend (e.g., in a generally vertical direction when looking at FIG. 10) substantially entirely through the gap G formed between the diffuser 20 and the pump housing 12.

More specifically, as shown in FIG. 10, the deflection structures 40*b* are arranged around the ring 150 and within the gap G so fluid flowing through the diffuser 20 along circular, undiverted path 44 encounters the face 142 of the deflection structure 40*b* and is deflected into a diverted path (represented by arrows 46 in FIG. 10) leading directly to the pump outlet 16. In this way, the deflection structures 40*b* act as walls to prevent the fluid from continuing in its circular path and instead deflect the fluid into an axial path that leads directly to the pump outlet 16. The walls of the pump housing 12 act as further flow deflectors to deflect the remainder of the fluid flow. In the embodiment of FIG. 10, a plane containing the longitudinal axis of the pump outlet 16 is offset from a plane containing the longitudinal axis of the diffuser 20. In this non-limiting example, the fluid contacting the deflection structures 40*b* is deflected approximately 90 degrees from the circular path 44 into the axial path 46 in FIG. 10 leading directly to the pump outlet 16.

In some examples, a majority of the fluid flowing through the diffuser 20 is diverted from the circular path 44 to the axial path 46 (for example more than 50%, more than 60%, more than 70%, more than 80%, more than 90%, or more than 95%) before recirculating within the gap G.

Figure 13:
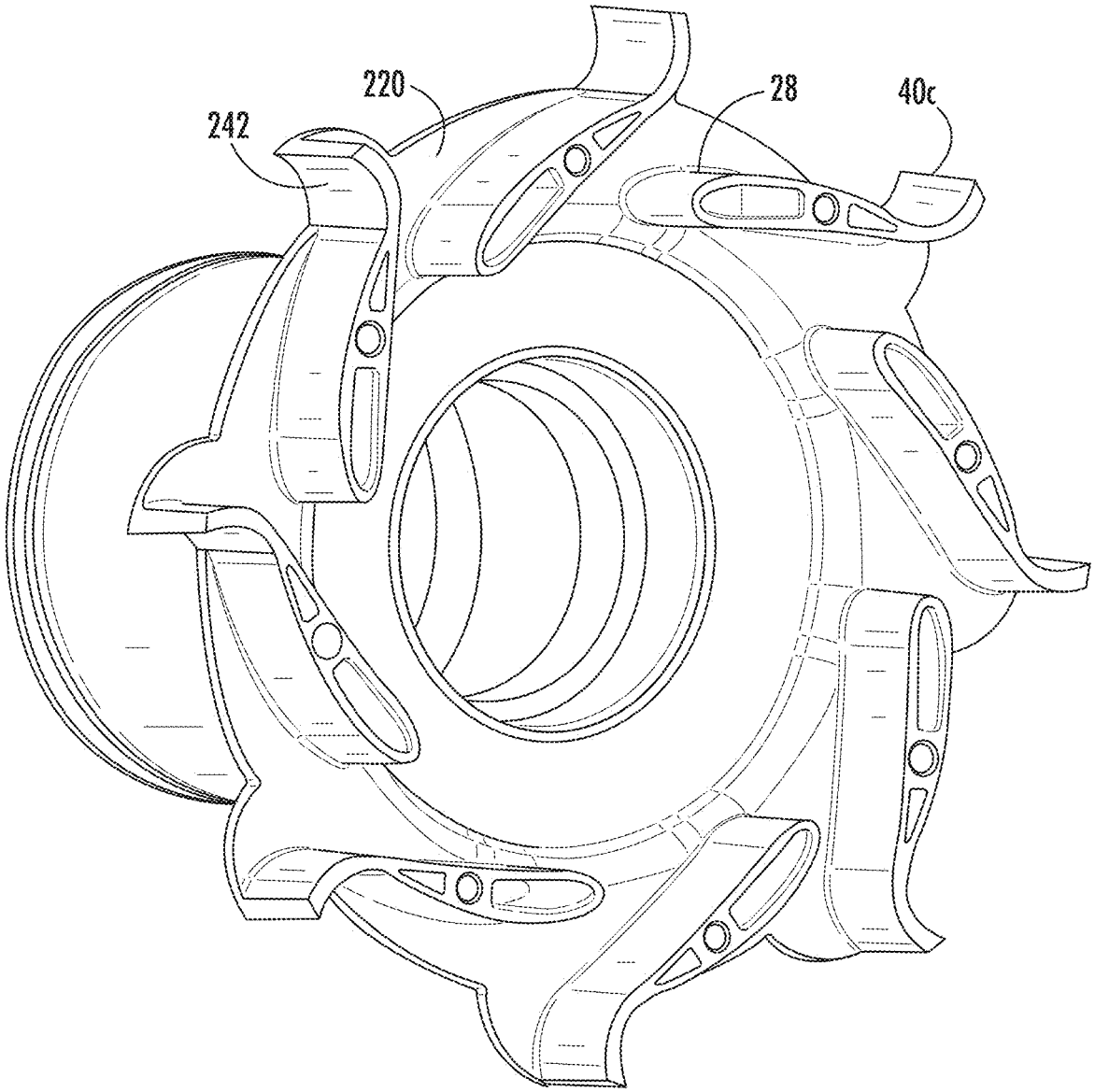
FIG. 13 is a perspective view of a diffuser of the pump of FIG. 11.
Figure 14:
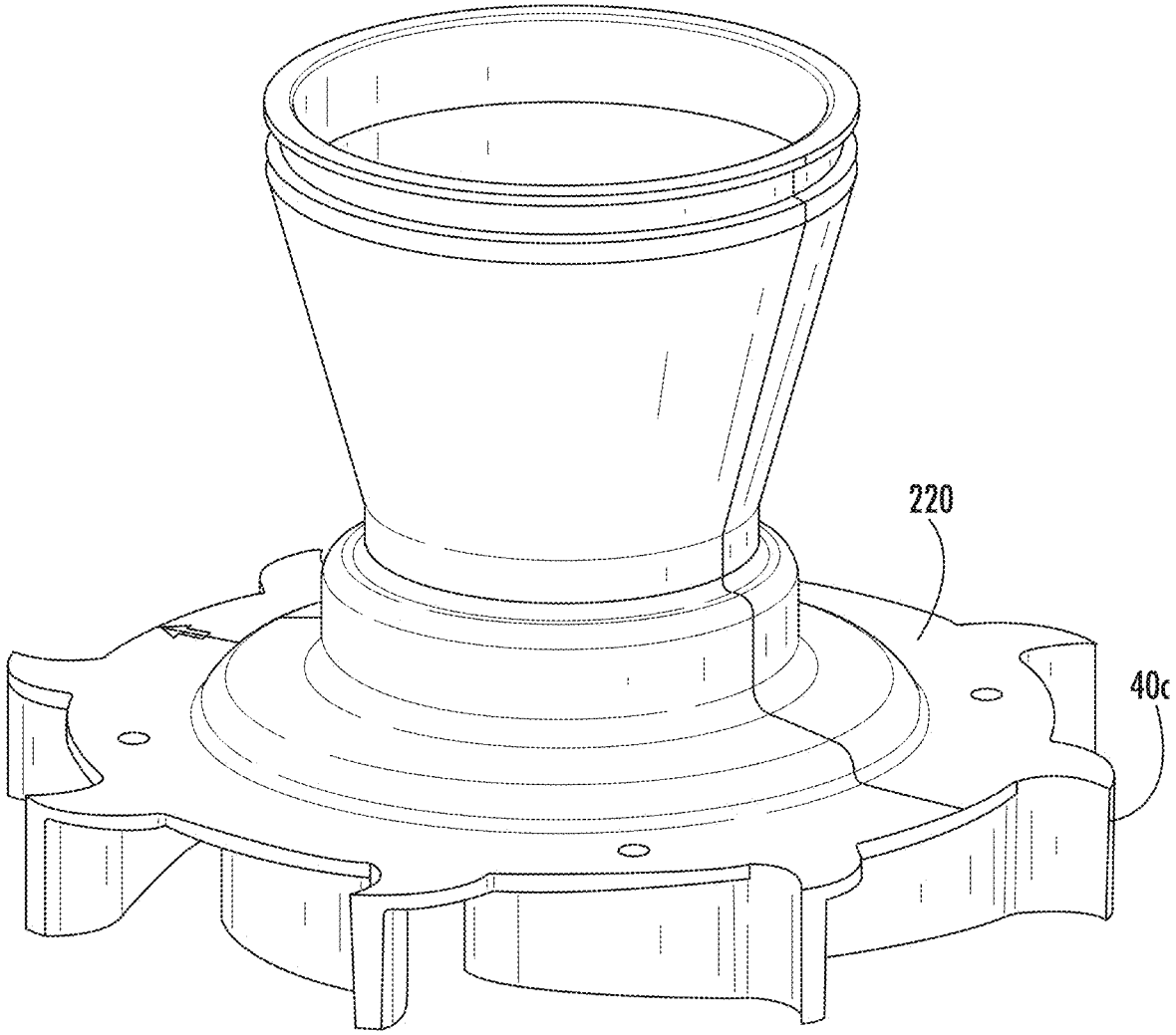
FIG. 14 is another perspective view of the diffuser of FIG. 13.
Figure 15:
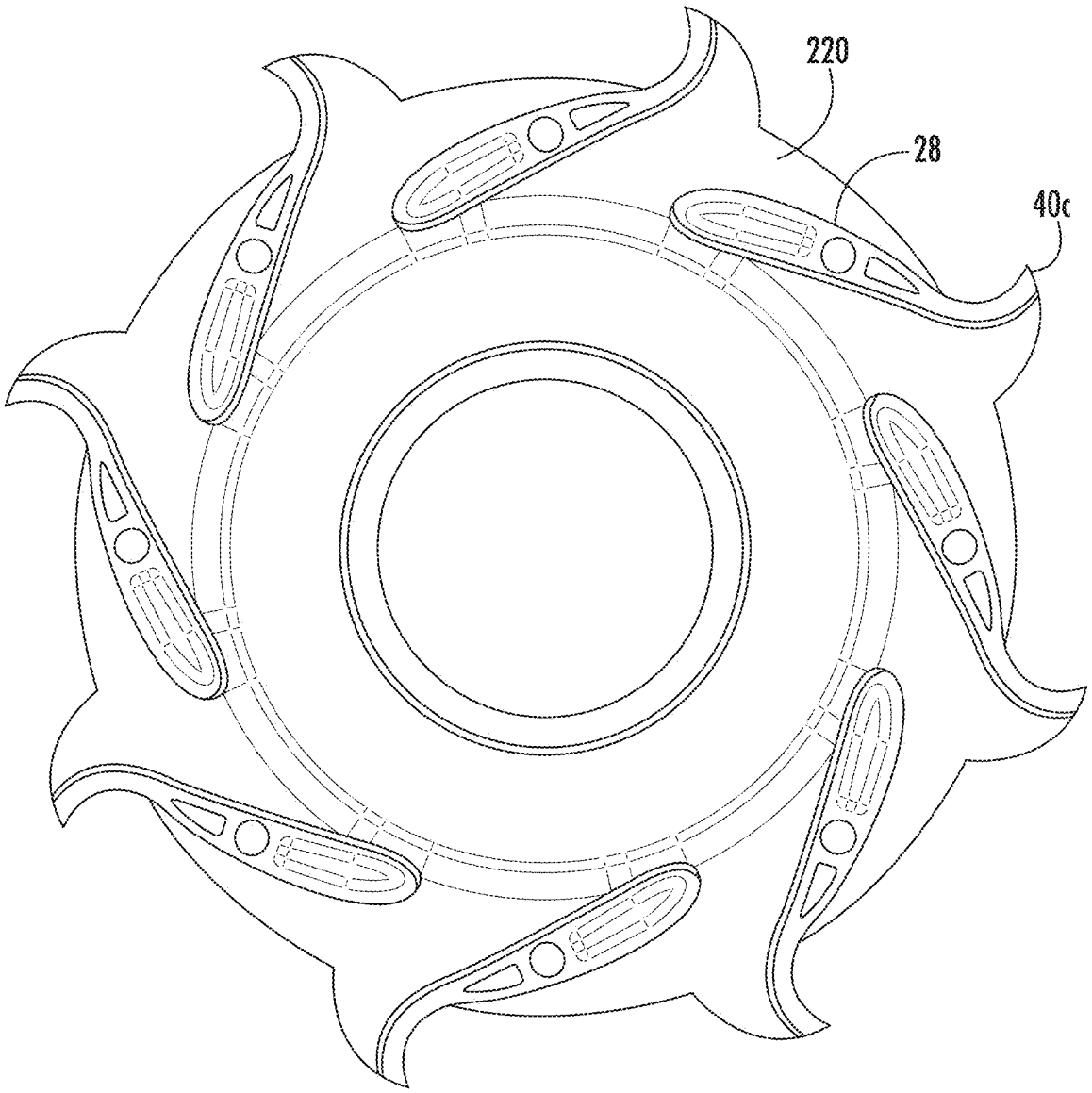
FIG. 15 is a rear view of the diffuser of FIG. 13.
Figure 16:
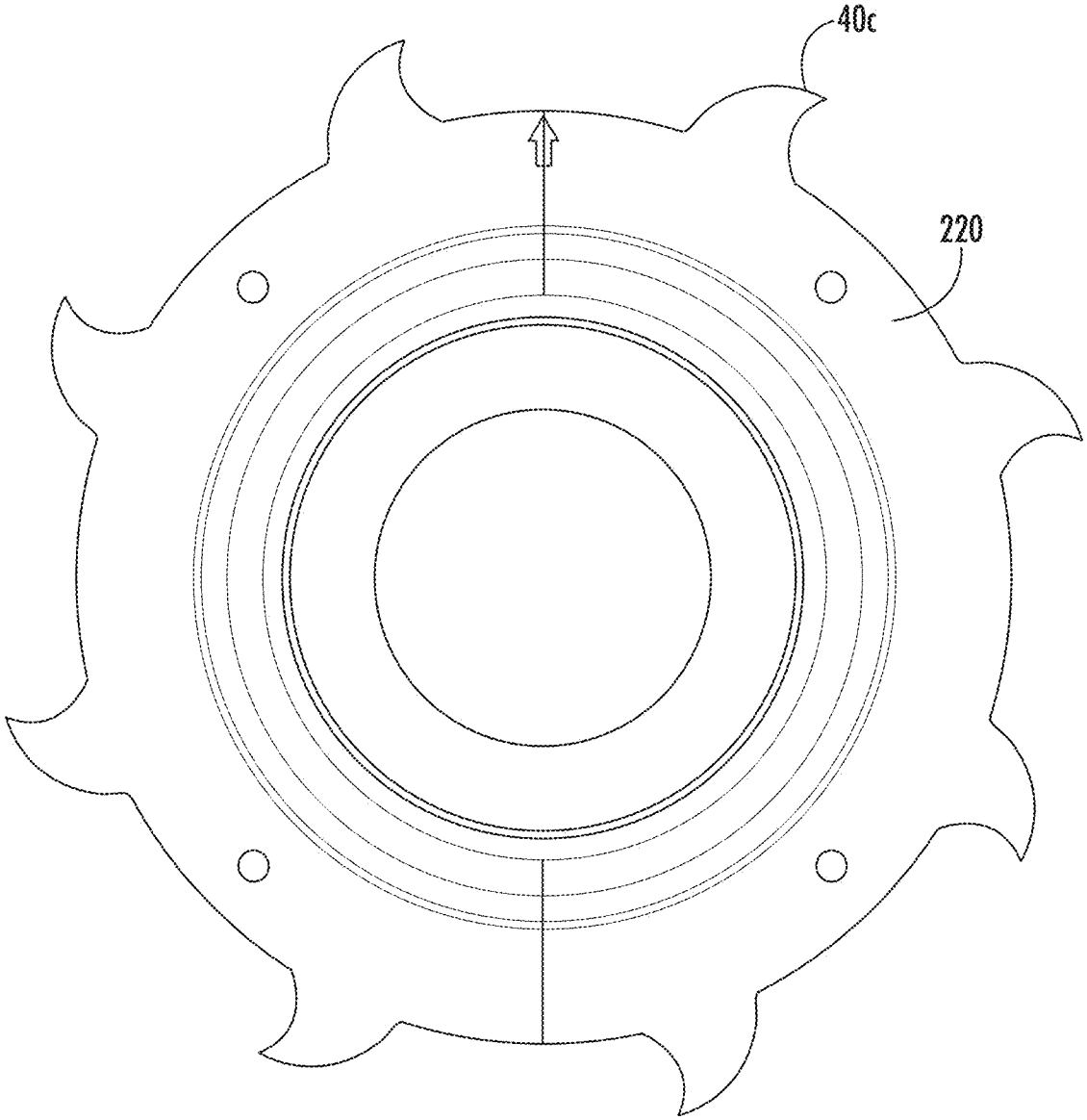
FIG. 16 is a front view of the diffuser of FIG. 13.
Figure 17:
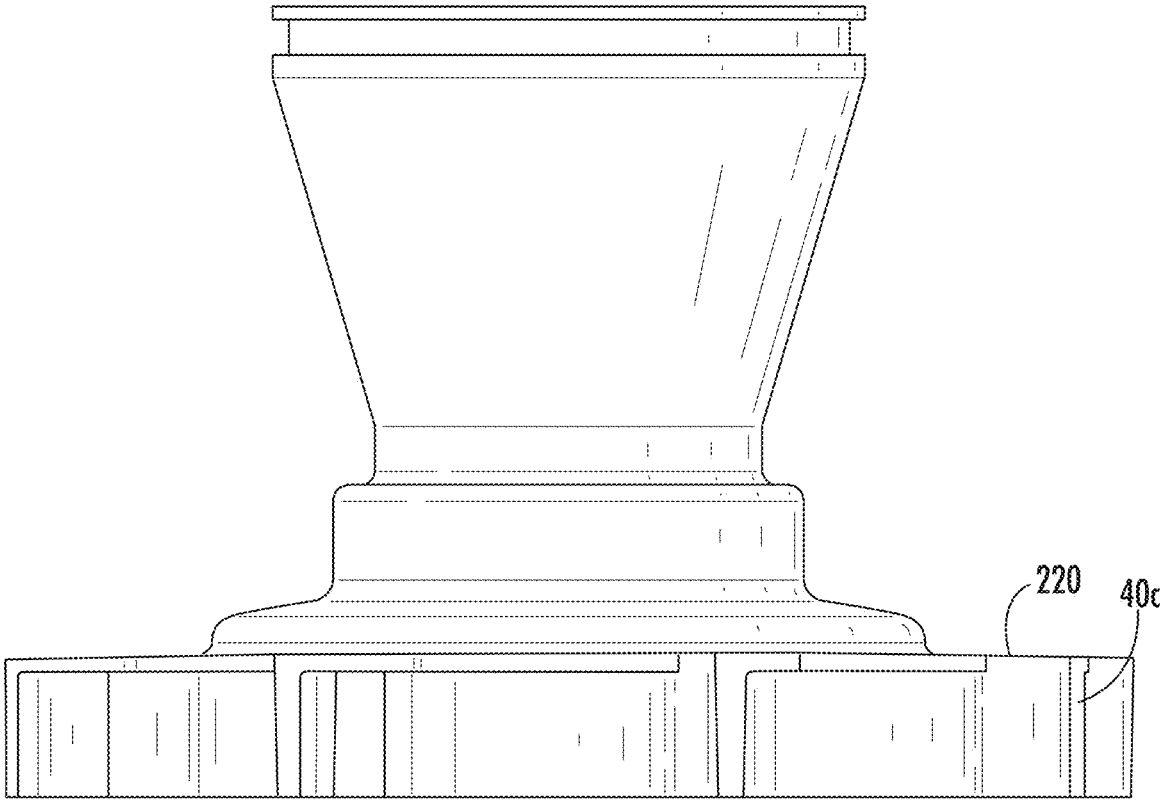
FIG. 17 is a top view of the diffuser of FIG. 13.
Figure 18:
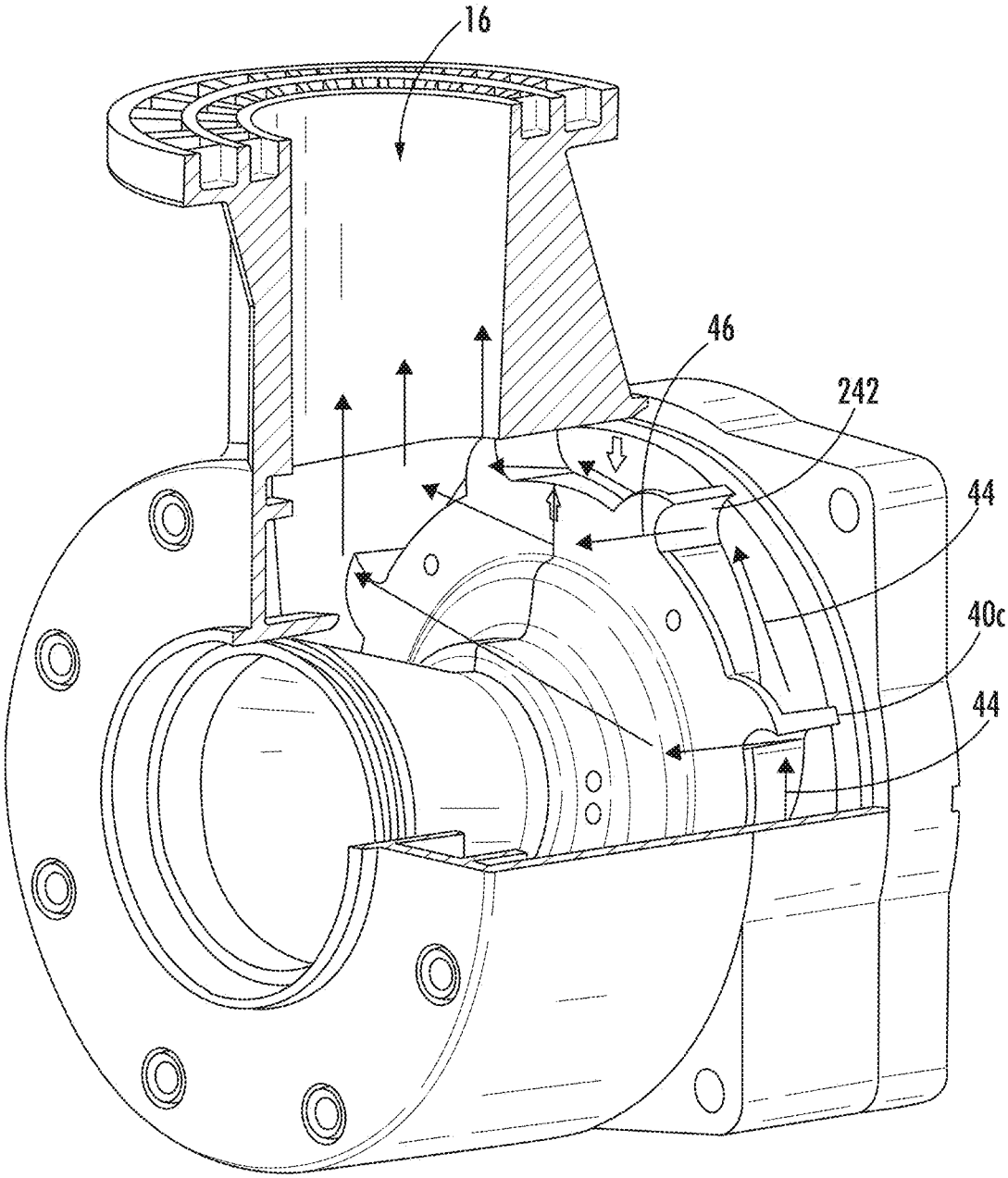
FIG. 18 is a perspective, cut-away view of the pump of FIG. 11.
Figure 19:
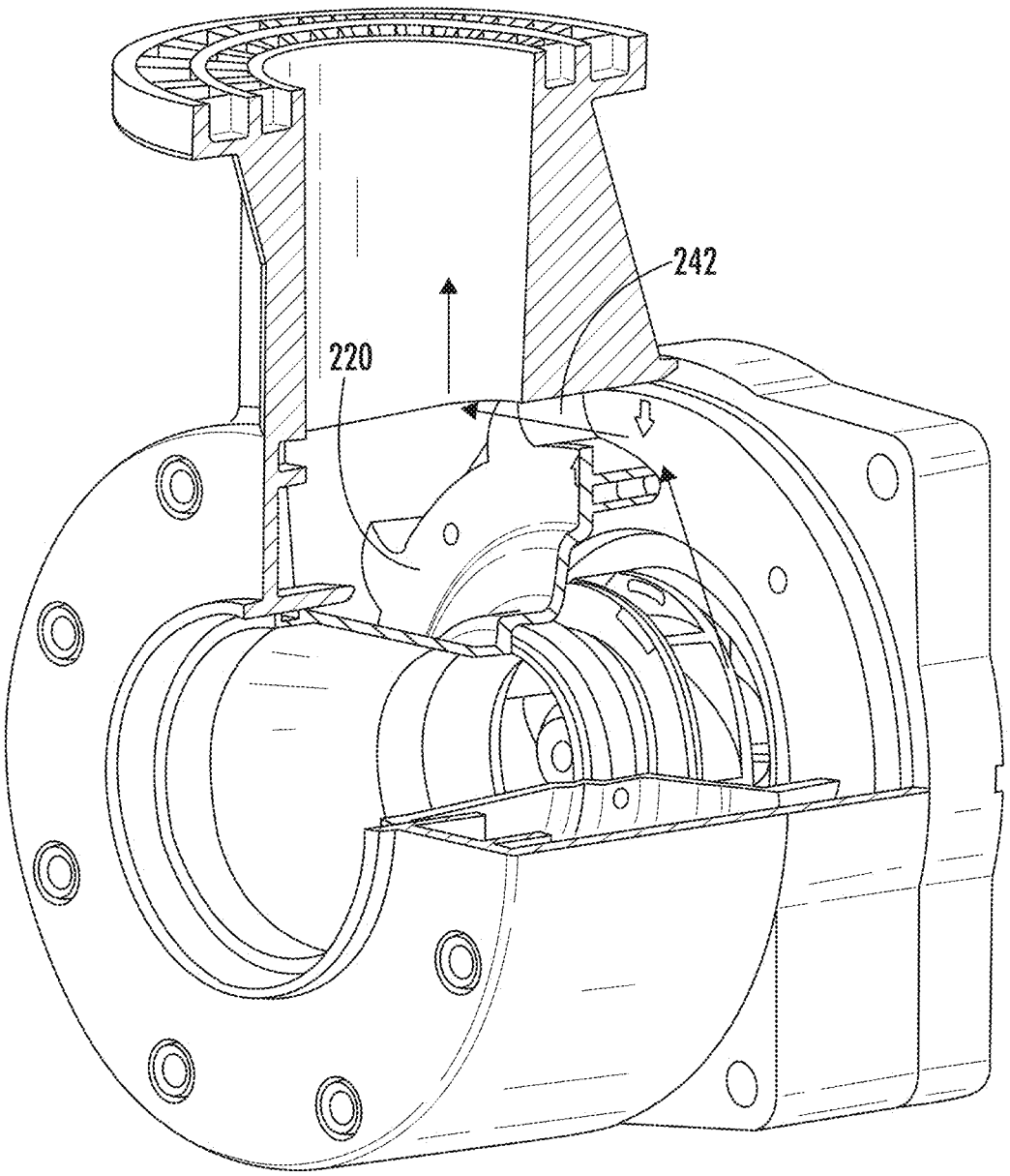
FIG. 19 is another perspective, cut-away view of the pump of FIG. 11.
Figure 20:
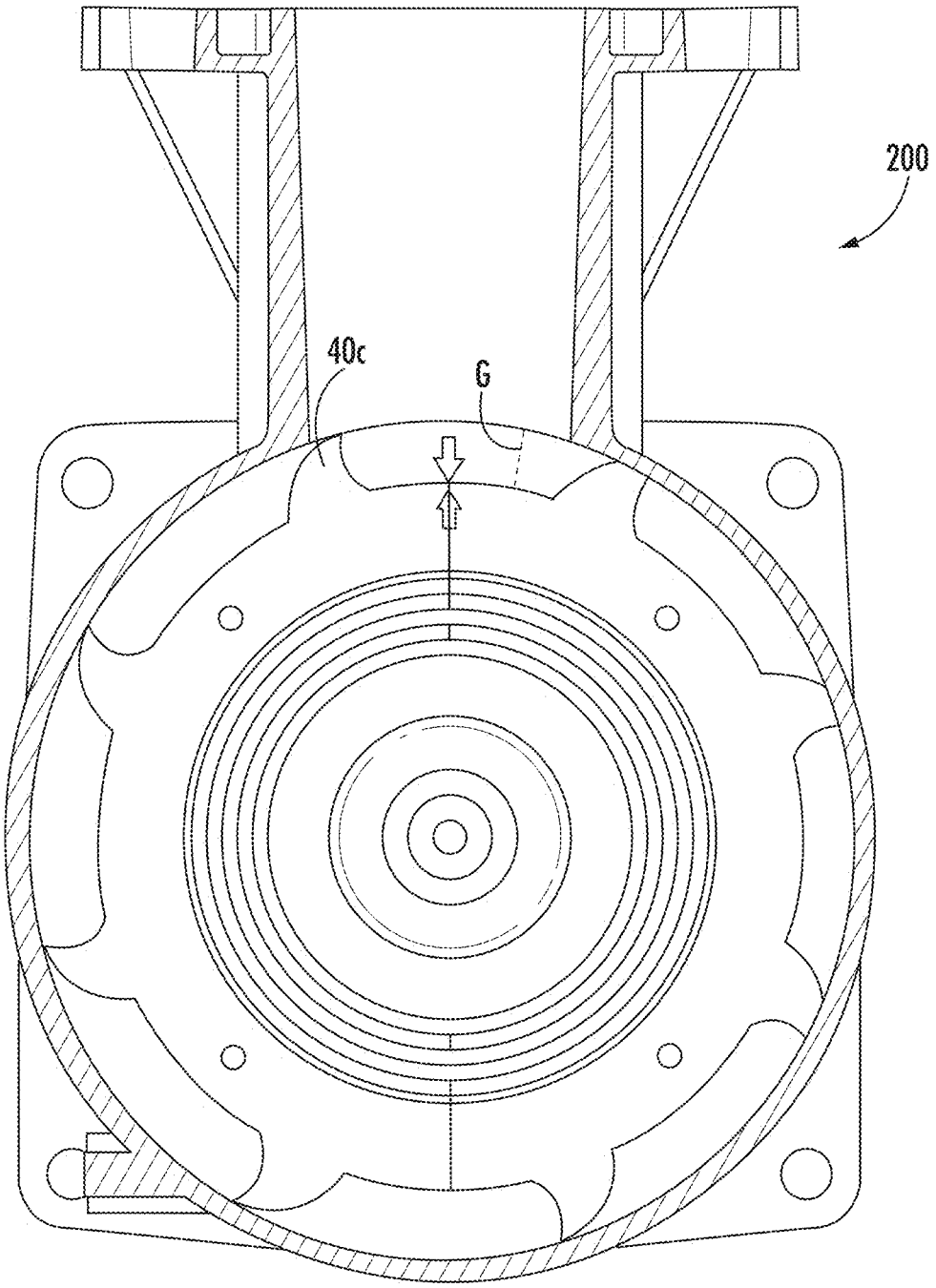
FIG. 20 is a front, cut-away view of the pump of FIG. 11.
Figure 21:
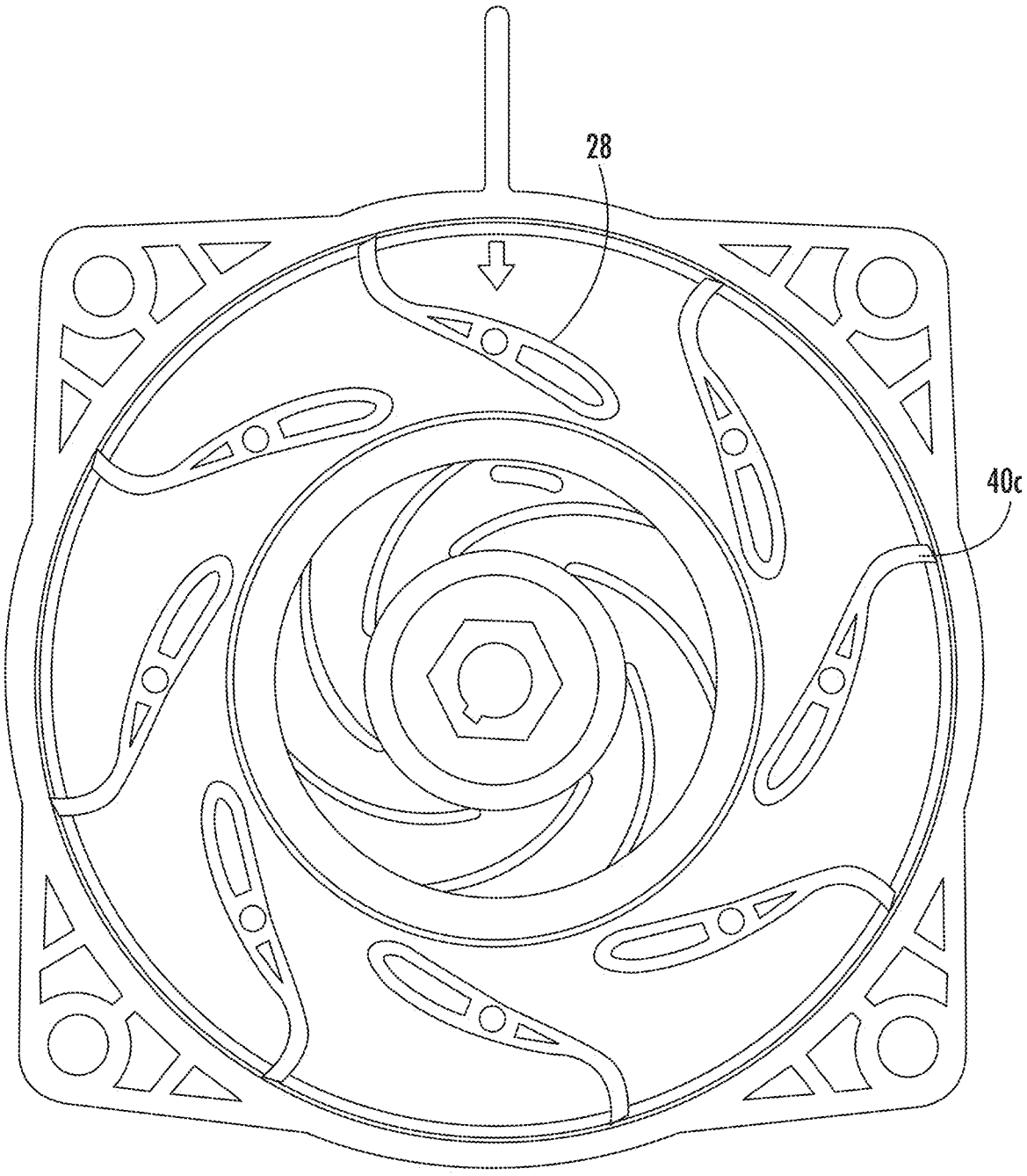
FIG. 21 is another cut-away view of the pump of FIG. 11.

FIGS. 11-21 show another example of a pump 200 having deflection structures for diverting flow. The pump 200 is similar to the pump 100 described above, except the deflection structures are integrated with the diffuser 220. More specifically, the diffuser 220 has a plurality of deflection structures 40*c* positioned around its circumference. In some cases, as shown in FIG. 13, each deflection structure 40*c* extends from a distal end of a vane 28 of the diffuser 220. As shown in FIG. 13, each deflection structure 40*c* can be a projection with a curved face 242. Referring to FIG. 20, the deflection structures 40*c* extend entirely through the gap G formed between the diffuser 220 and the pump housing, ensuring that fluid flowing in a circular path through the gap G of the diffuser 220 contacts the curved face 242 of the deflection structures 40*c*.

Figure 22:
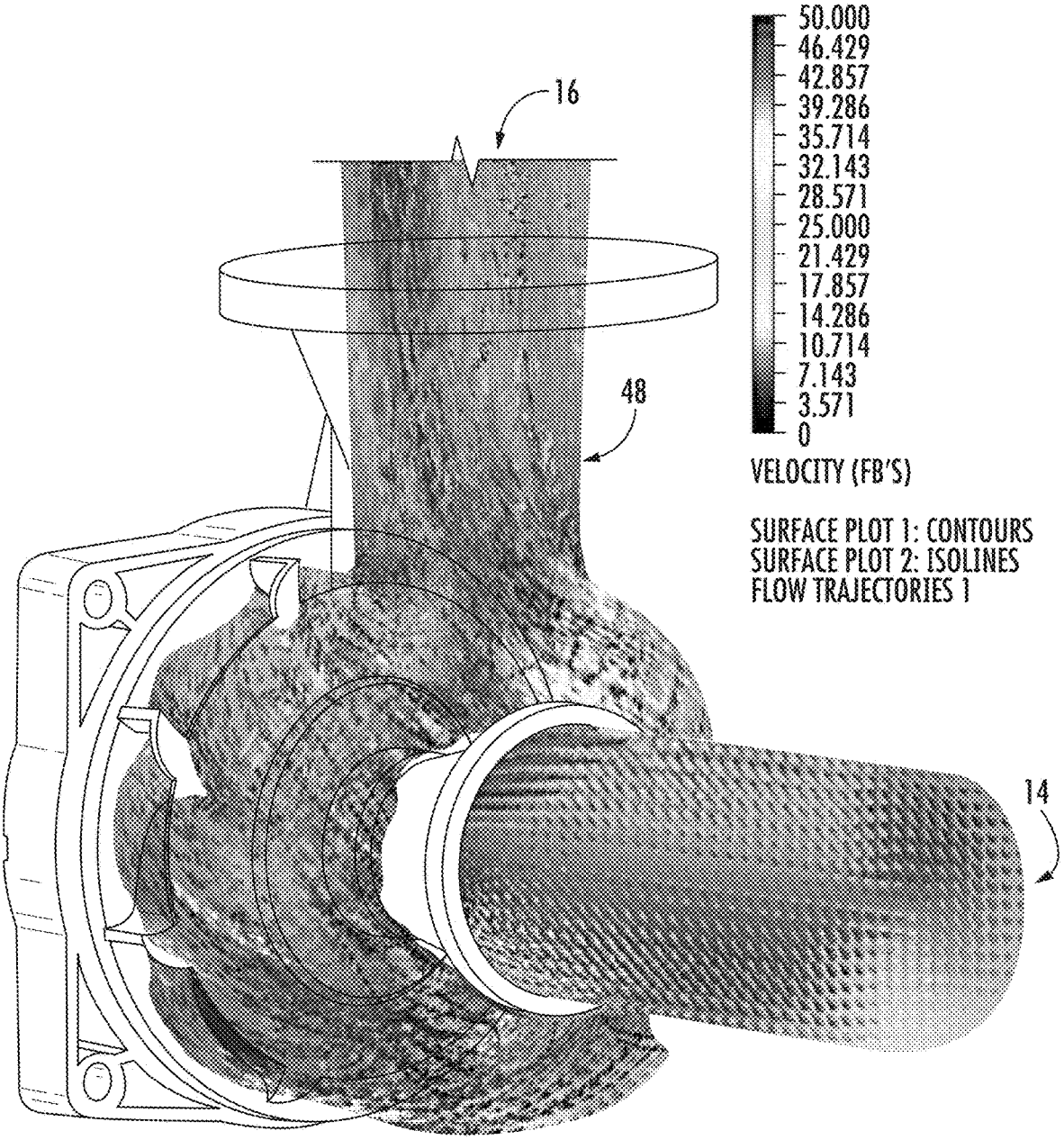
FIG. 22 is a perspective view of simulation of fluid flow through the pump of FIG. 11.
Figure 23:
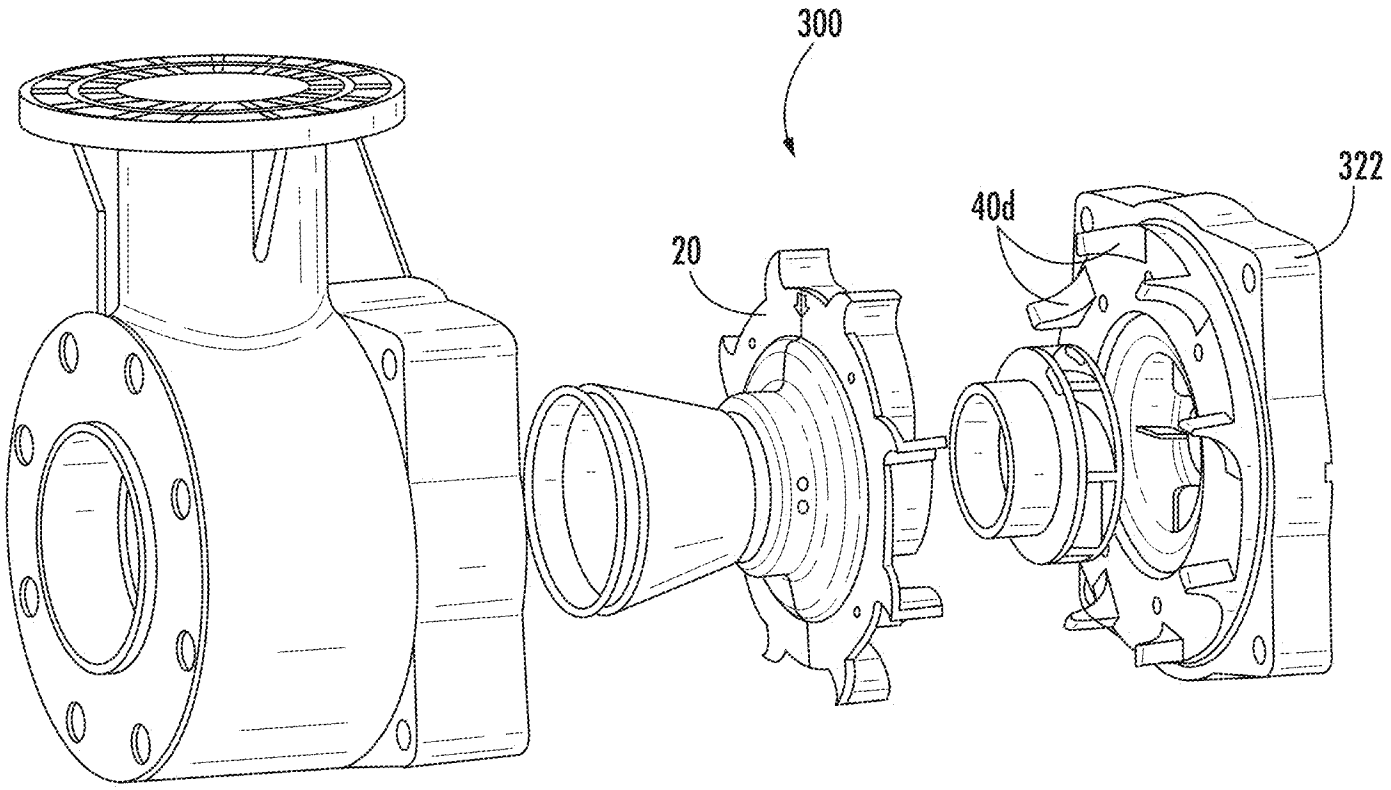
FIG. 23 is an exploded view of another exemplary pump of the present invention.

Like the deflection structures 40*b*, the deflection structures 40*c* are configured to block the circular path (represented by arrows 44) of the fluid and divert it into a diverted path (represented by arrows 46 in FIG. 18) leading directly to the pump outlet 16. In this way, the deflection structures 40*c* act as walls to prevent the fluid from continuing in its circular path and instead deflect the fluid into an axial path that leads directly to the pump outlet 16. The walls of the pump housing 12 act as further flow deflectors to deflect the remainder of the fluid flow. In the non-limiting embodiment of FIG. 18, a plane containing the longitudinal axis of the pump outlet 16 is offset from a plane containing the longitudinal axis of the diffuser 220. Therefore, in this example, the fluid contacting the deflection structures 40*c* is deflected approximately 90 degrees from the circular path 44 into the axial path 46 in FIG. 18 leading directly to the pump outlet 16. In some examples, the deflection structures 40*c* force the fluid into a helical shape 48, as shown in green in FIG. 22.

In some examples, a majority of the fluid flowing through the diffuser 220 is diverted from the circular path 44 to the axial path 46 (for example more than 50%, more than 60%, more than 70%, more than 80%, more than 90%, or more than 95%) before recirculating within the gap G.

FIGS. 23-27 show another example of a pump 300 having deflection structures. The pump 300 is similar to the pump 10 described above, except the deflection structures are provided on the seal plate 322. In the embodiment of FIGS. 23-27, the deflection structures are ramps 40*d*. Like the deflection structures 40*a*-40*c*, the deflection structures 40*d* are positioned within the gap G between the outer diameter of the diffuser 20 and the inner diameter of the pump housing 12 to block fluid flowing in a circular path through the diffuser and divert it to a path leading directly toward the pump outlet.

Figure 24:
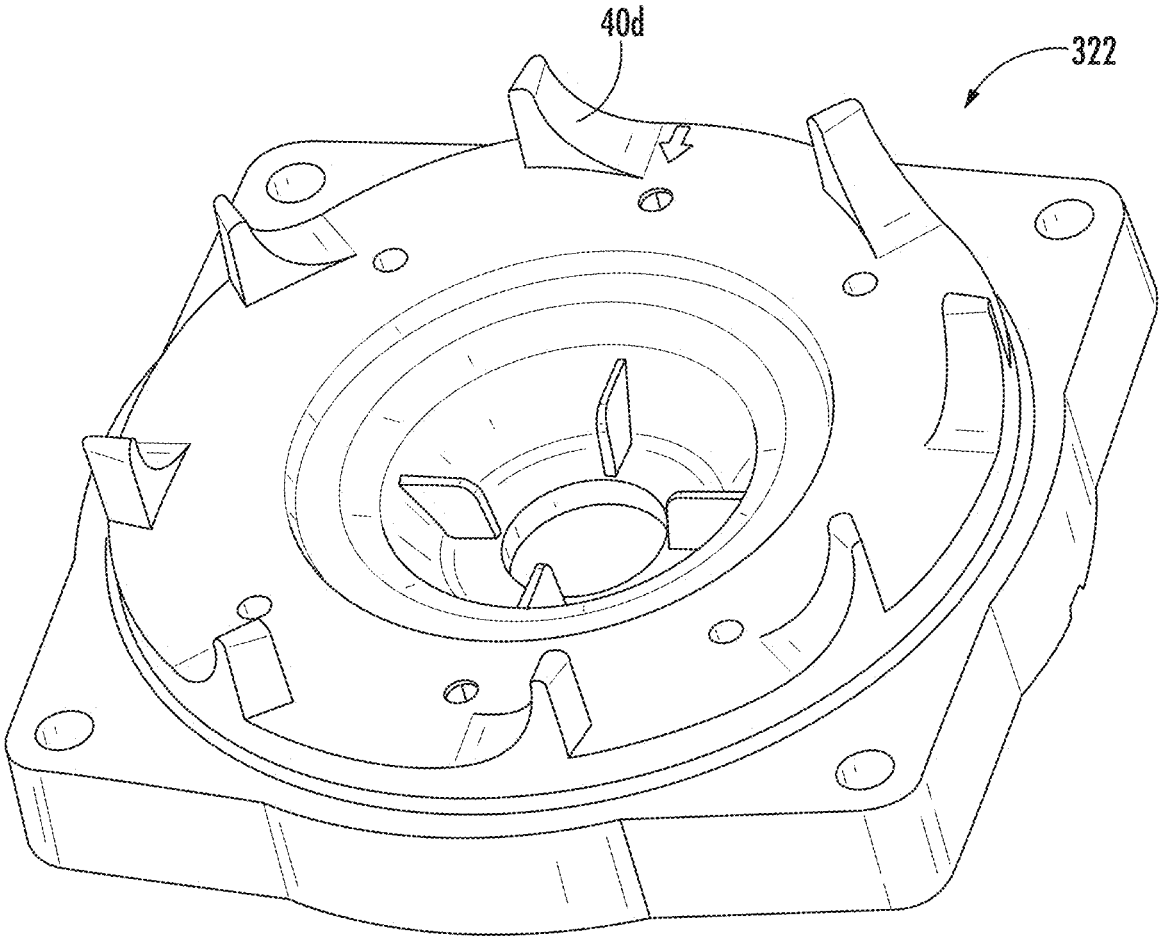
FIG. 24 is a perspective view of a seal plate of the pump of FIG. 23.
Figure 25:
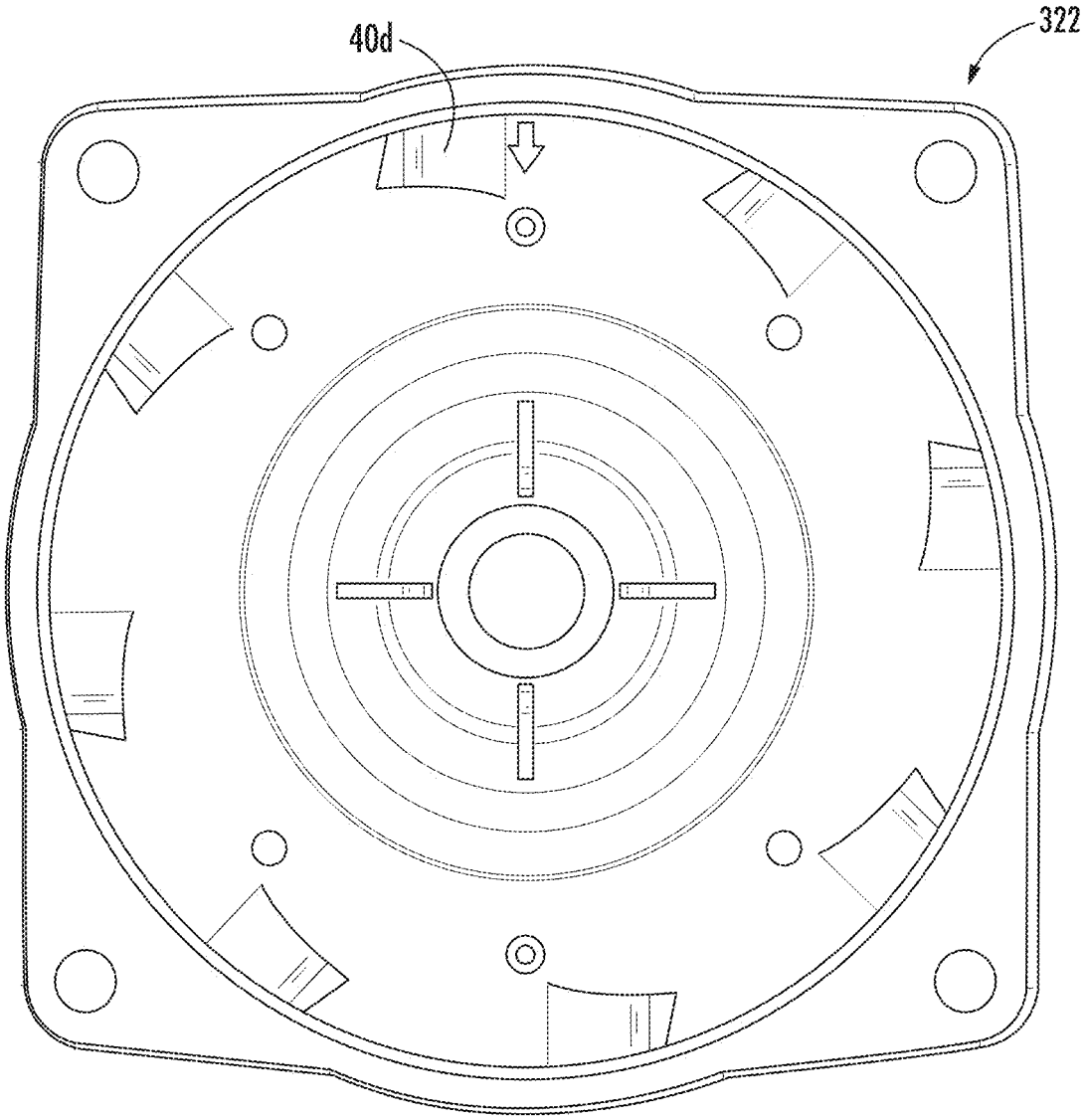
FIG. 25 is a front view of the seal plate of the pump of FIG. 23.
Figure 26:
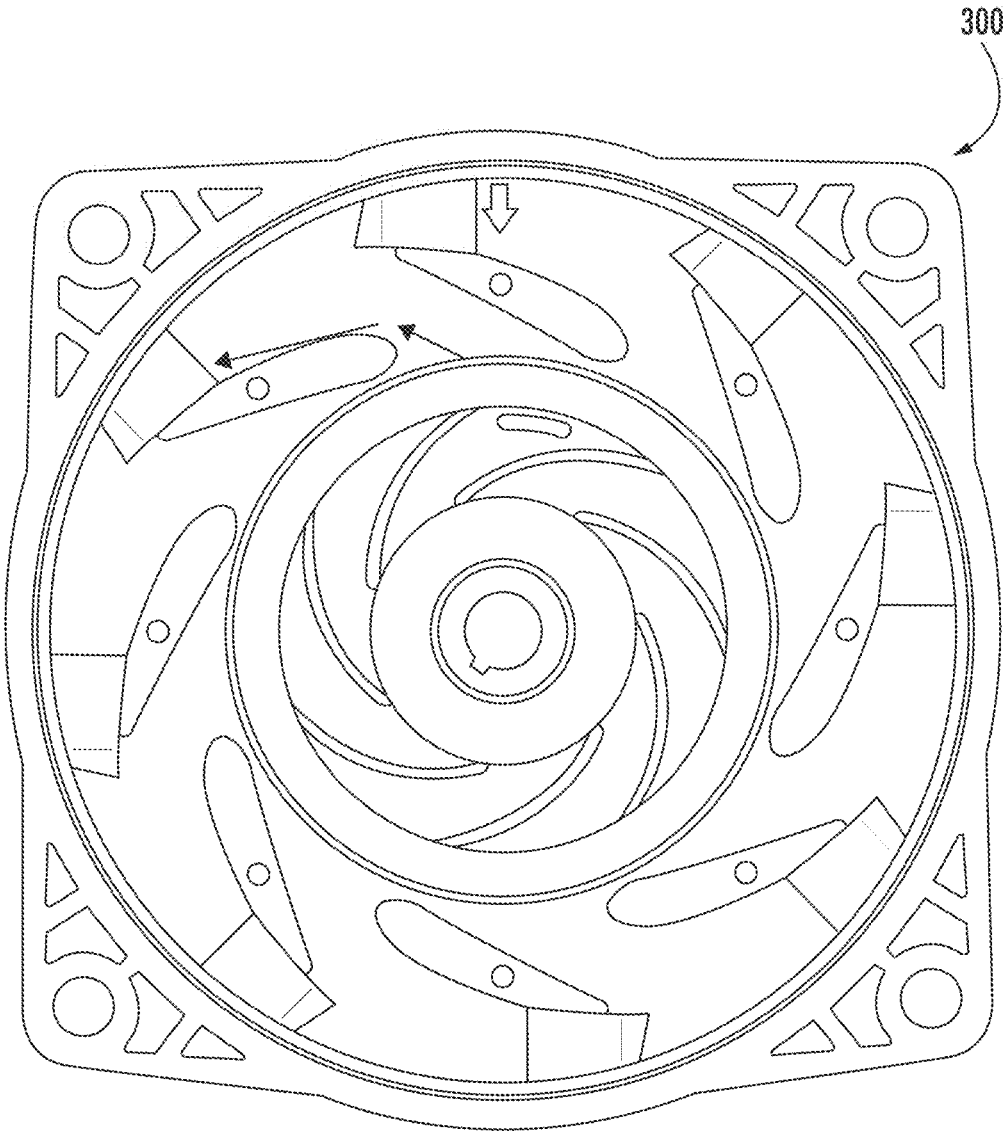
FIG. 26 is a front, cut-away view of aspects of the pump of FIG. 23.
Figure 27:
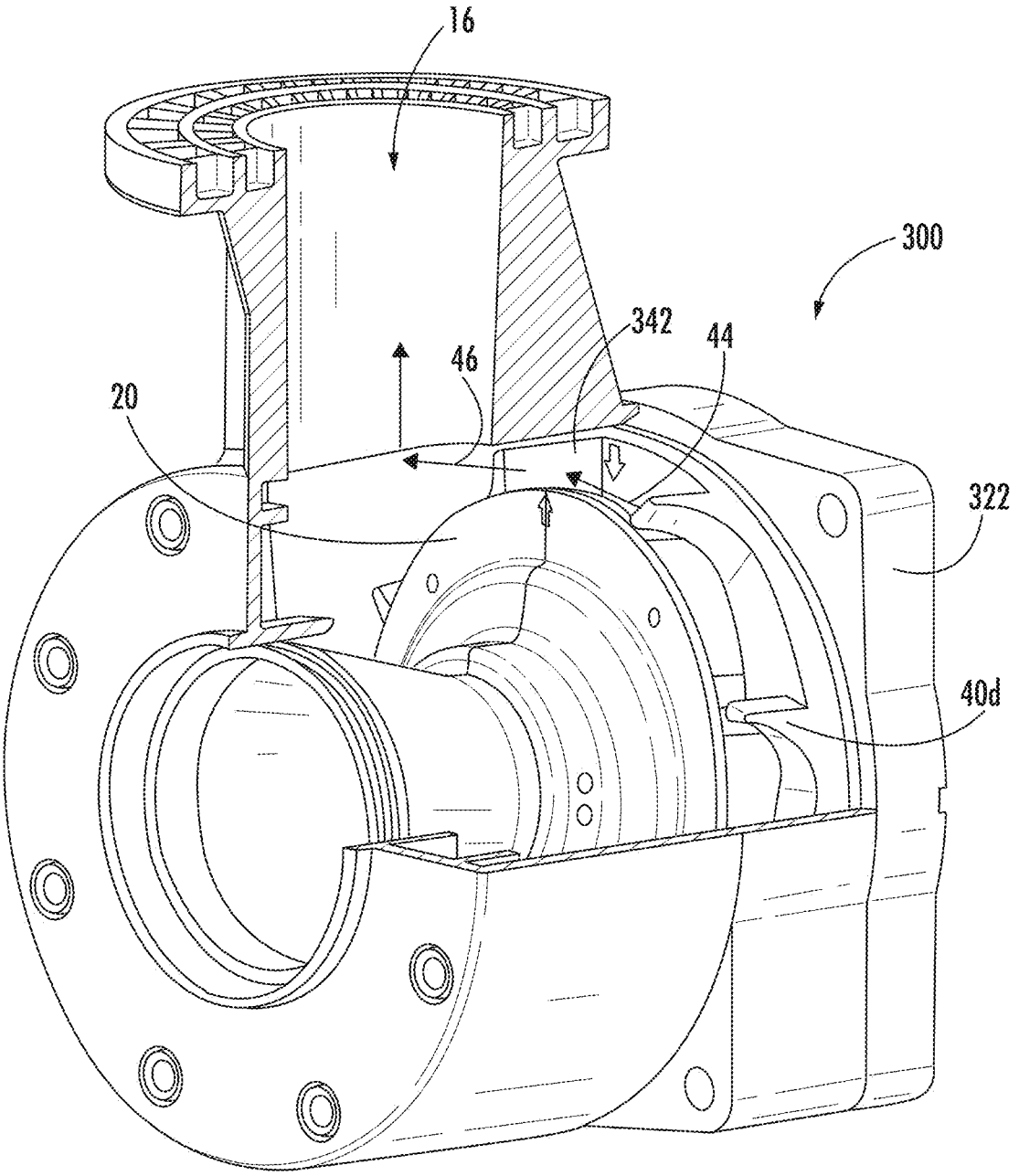
FIG. 27 is a perspective, cut-away view of the pump of FIG. 23.
Figure 28:
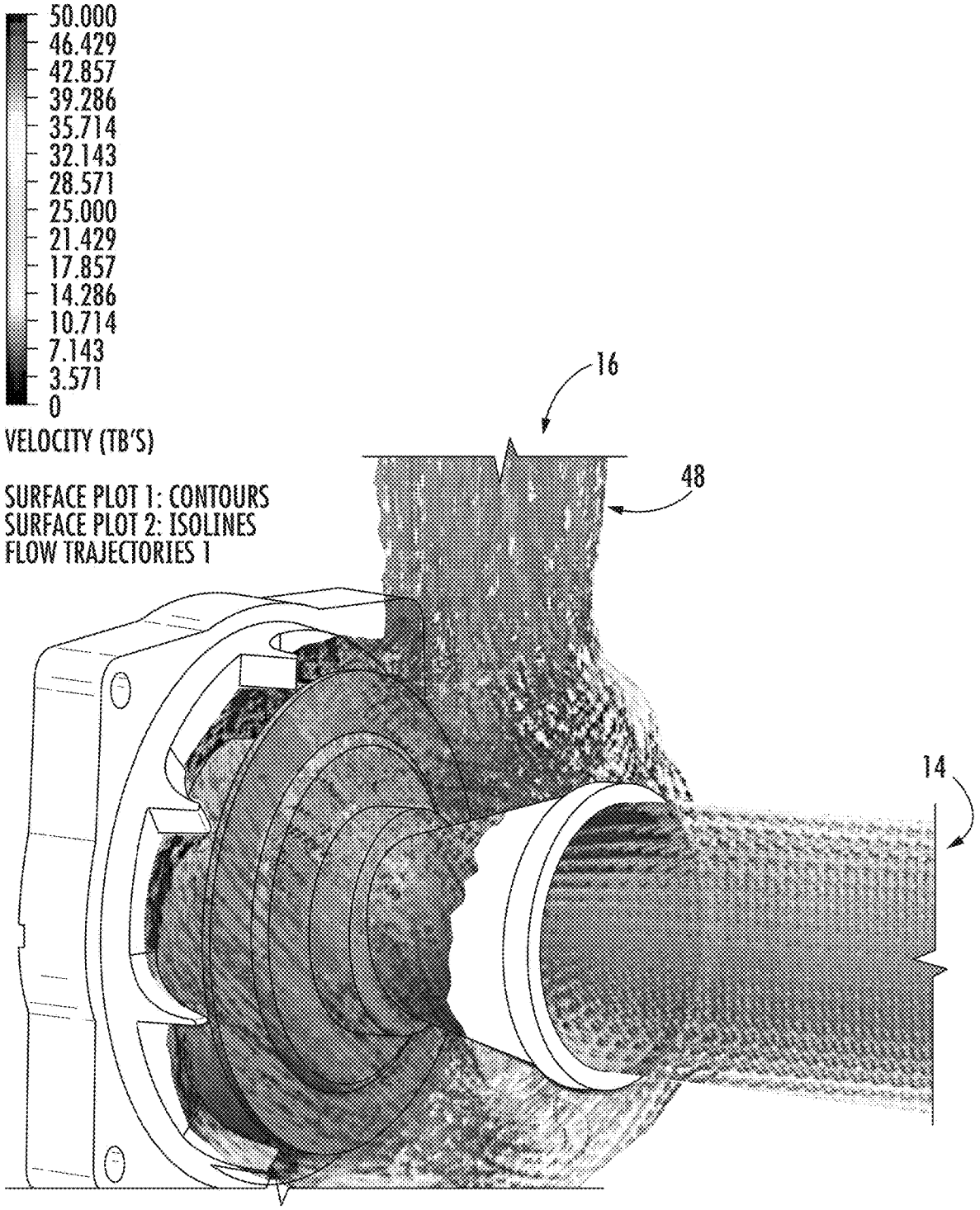
FIG. 28 is a perspective view of simulation of fluid flow through the pump of FIG. 23.
Figure 29:
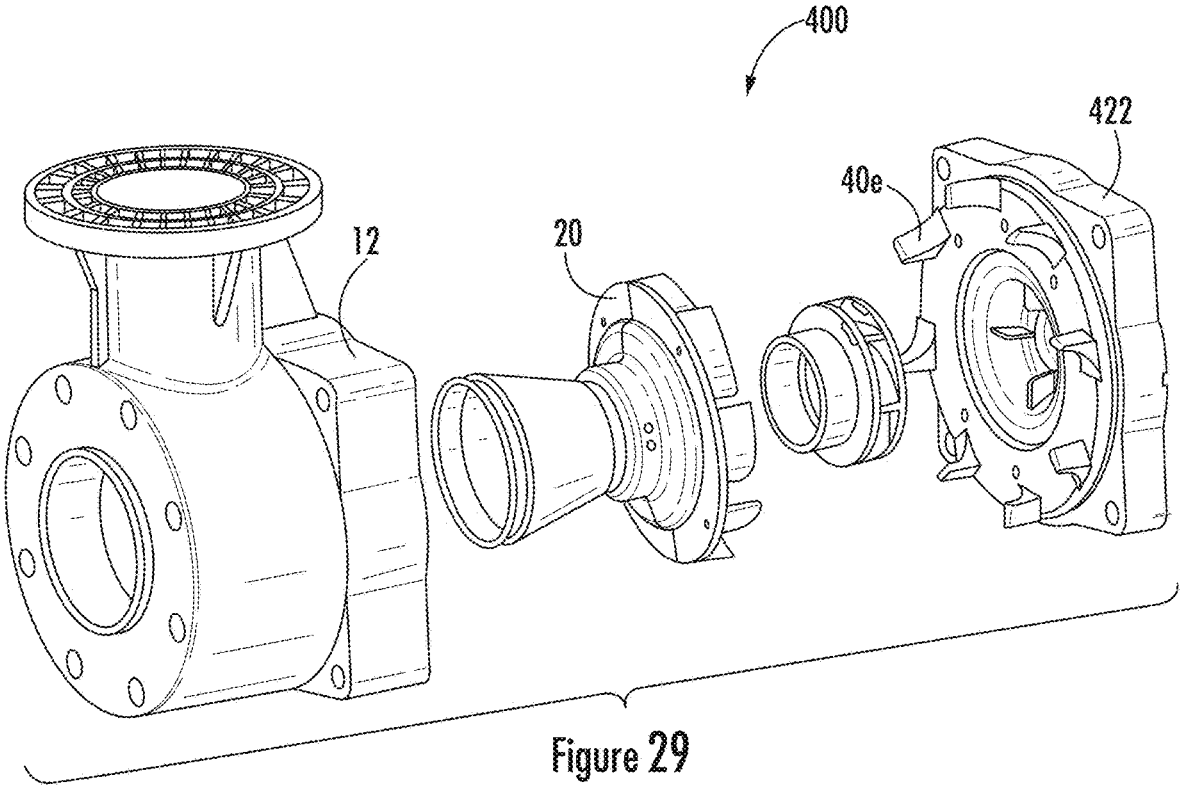
FIG. 29 is an exploded view of another exemplary pump of the present invention.

More specifically, as shown in FIG. 24, the deflection structures 40*d* are arranged as ramps along the seal plate 322. The ramps 40*d* extend axially (e.g., generally horizontally when looking at FIG. 27) into the interior of the pump 300. The ramps 40*d* also project into the gap G so fluid circulating through the diffuser 20 contacts them. As shown in FIG. 27, once the fluid flowing along circular, undiverted path (represented by arrow 44) through the gap G of the diffuser 20 encounters a face 342 of a ramp 40*d*, it is deflected into a diverted path (represented by arrow 46 in FIG. 27) toward the pump outlet 16. In this way, the deflection structures 40*d* act as walls to prevent the fluid from continuing in its circular path and instead deflect the fluid into an axial path that leads directly to the pump outlet 16. The walls of the pump housing 12 act as further flow deflectors to deflect the remainder of the fluid flow. In the non-limiting embodiment of FIG. 27, a plane containing the longitudinal axis of the pump outlet 16 is offset from a plane containing the longitudinal axis of the diffuser 20. Therefore, in this example, the fluid contacting the deflection structures 40*d* is deflected approximately 90 degrees from the circular path 44 into the axial path 46 in FIG. 27 leading directly to the pump outlet 16. In some examples, diverted path 46 forces the fluid into a helical shape 48, as shown in green in FIG. 28.

FIGS. 29-32 show another example of a pump 400 having deflection structures. The pump 400 is similar to the pump 300 described above, except, when assembled, the deflection structures (shown as ramps 40*e*) provided on the seal plate 422 extend axially (e.g., generally horizontally when looking at FIG. 32) to the pump housing 12. Like the deflection structures 40*a*-40*d*, the deflection structures 40*e* are positioned within the gap G between the outer diameter of the diffuser 20 and the inner diameter of the pump housing 12 to divert fluid flowing in a circular path through the diffuser into a path leading directly toward the pump outlet 16.

Figure 30:
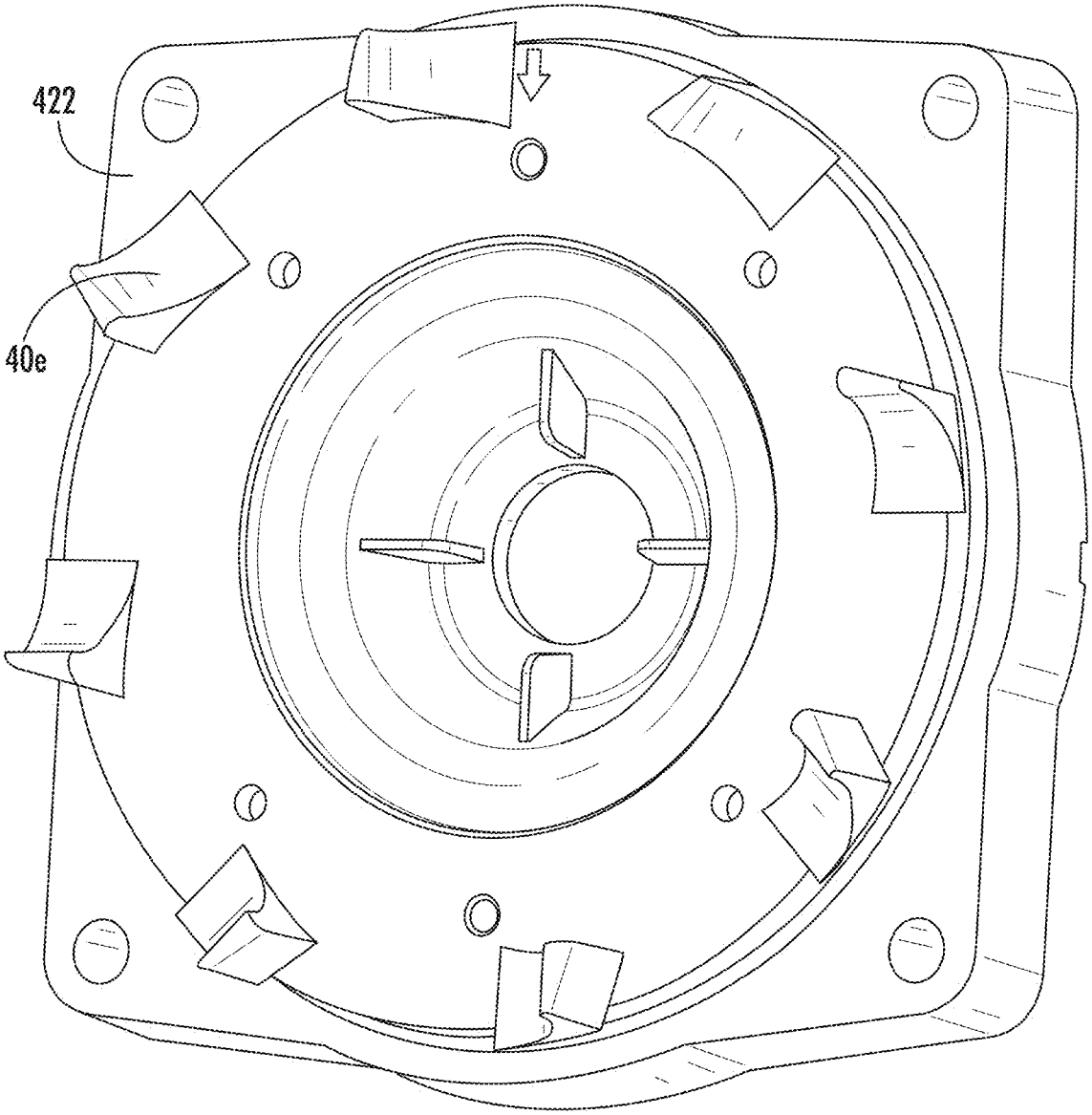
FIG. 30 is a perspective view of a seal plate of the pump of FIG. 29.
Figure 31:
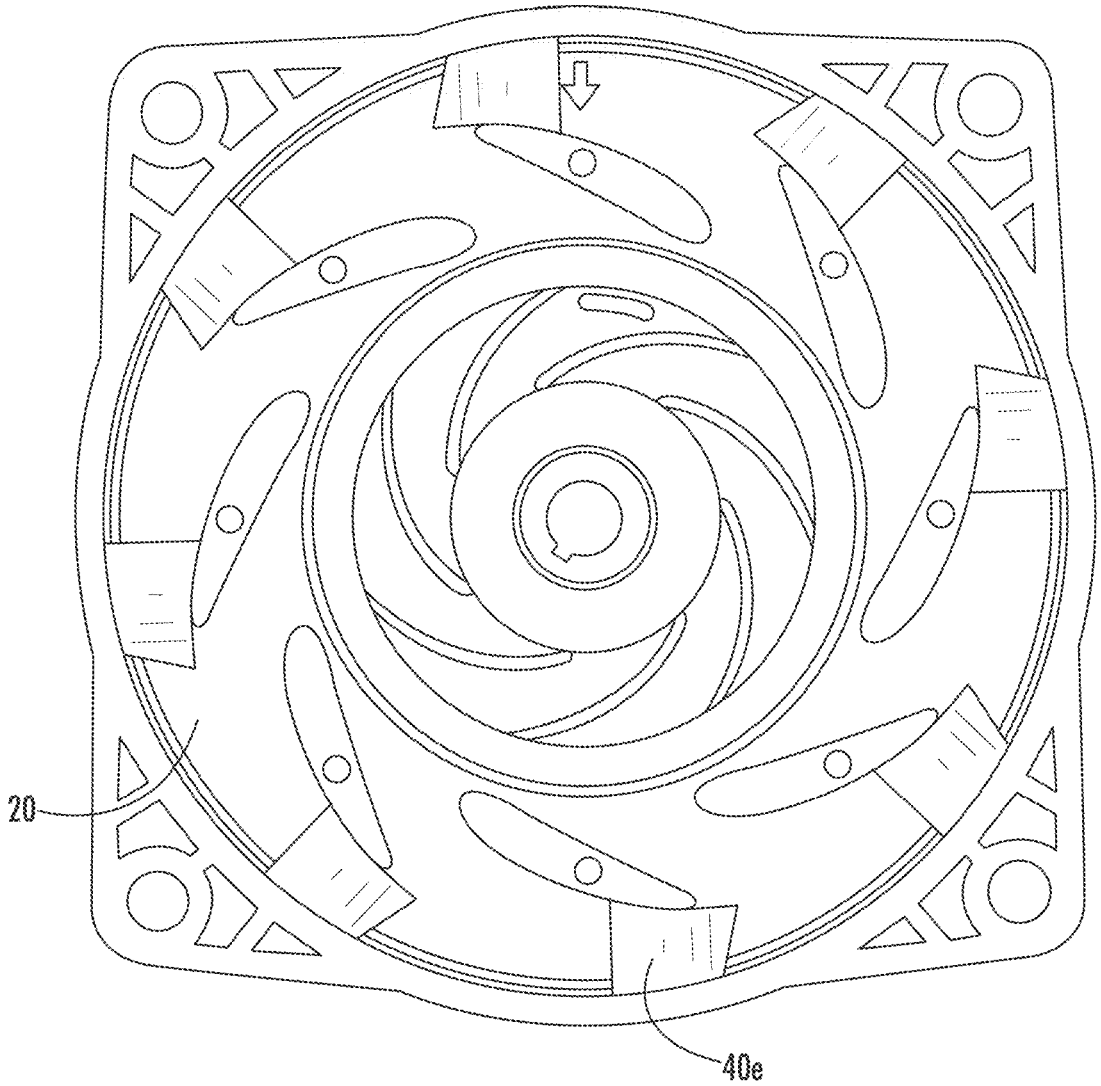
FIG. 31 is a front, cut-away view of aspects of the pump of FIG. 29.
Figure 32:
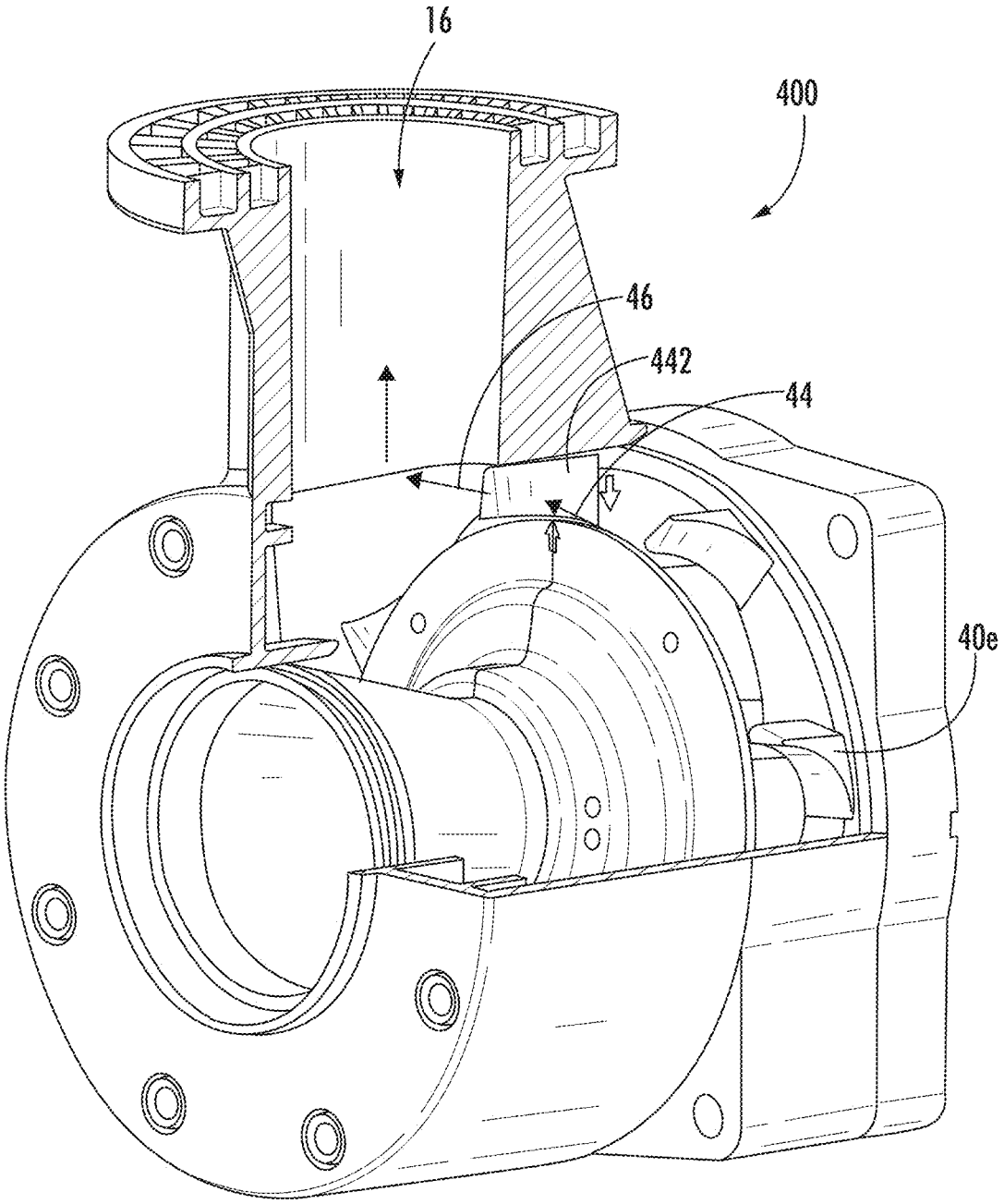
FIG. 32 is a perspective, cut-away view of the pump of FIG. 29.

More specifically, as shown in FIG. 30, the deflection structures 40*e* are arranged as ramps along the seal plate 422. The ramps 40*e* extend into the interior of the pump 300 and into the gap G so they are in the path of fluid flowing through the diffuser 20. As shown in FIG. 32, once the fluid flowing along circular, undiverted path (represented by arrow 44) through the diffuser 20 encounters a face 442 of a ramp 40*e*, it is deflected into a diverted path (represented by arrow 46 in FIG. 32) toward the pump outlet 16. In this way, the deflection structures 40*e* act as walls to prevent the fluid from continuing in its circular path and instead deflect the fluid into an axial path that leads directly to the pump outlet 16. The walls of the pump housing 12 act as further flow deflectors to deflect the remainder of the fluid flow.

In the non-limiting embodiment of FIG. 32, a plane containing the longitudinal axis of the pump outlet 16 is offset from a plane containing the longitudinal axis of the diffuser 20. In this example, the fluid contacting the deflection structures 40*e* is deflected approximately 90 degrees from the circular path 44 into the axial path 46 leading directly to the pump outlet 16.

As previously mentioned, a pump according to the invention can include any number and combination of deflection structures.

ILLUSTRATIVE ASPECTS

As used below, any reference to a non-enumerated group of aspects (e.g., "any previous or subsequent aspect") is to be understood as a reference to each of those aspects disjunctively (e.g., "Aspects A, B, C, or D" and so forth).

Aspect A is a pump for improved priming performance, the pump comprising at least one deflection structure configured to divert fluid moving through a diffuser from a circular path directly to an outlet of the pump.

Aspect B is a pump for improved priming performance, the pump comprising at least one deflection structure extending at least partially into a gap formed between an outer diameter of a diffuser and an inner diameter of a housing of the pump.

Aspect C is a pump for improved priming performance, the pump comprising at least one deflection structure configured to prevent fluid from recirculating within a diffuser through a gap formed between an outer diameter of the diffuser and an inner diameter of a housing of the pump.

Aspect D is a pump for improved priming performance, the pump comprising at least one deflection structure configured to divert fluid flowing through a diffuser in a circular path into an axial path leading directly to an outlet of the pump, where the at least one deflection structure is a rib, a wall, a ramp, a projection, a curved surface, a twisted surface, or an extension.

Aspect E is a pump for improved priming performance, the pump comprising at least one deflection structure extending at least partially into a gap formed between an outer diameter of a diffuser and an inner diameter of a housing of the pump, the at least one deflection structure configured to modify a path of fluid flowing through the gap and wherein the at least one deflection surface is on at least one of: an interior wall of a housing of the pump; a surface of a seal plate of the pump; a ring configured to couple with the diffuser; an impeller of the pump; or the diffuser.

Aspect F is a pump including any of the aspects identified in any of the previous statements A-E.

Aspect G is methods for using the pump in any of the previous statements A-E.

Aspect H is a pump for improved priming performance of a swimming pool or spa, the pump comprising means for diverting fluid moving through a diffuser from a circular path directly to an outlet of the pump.

Aspect I is a pump of any previous or subsequent aspect, wherein the means for diverting diverts a majority of the fluid moving through the diffuser from the circular path to an axial path generally perpendicular to the circular path.

Aspect J is a pump of any previous or subsequent aspect, wherein the means for diverting is at least one deflection structure extending at least partially into a gap formed between an outer diameter of the diffuser and an inner diameter of a housing of the pump.

Aspect K is a pump of any previous or subsequent aspect, wherein the at least one deflection structure extends completely or nearly completely through the gap, thereby preventing the fluid from recirculating within the gap along the circular path.

Aspect L is a pump of any previous or subsequent aspect, where the means for diverting is a rib, a wall, a ramp, a projection, a curved surface, a twisted surface, or an extension.

Aspect M is a pump of any previous or subsequent aspect, wherein the means for diverting is configured to divert the fluid moving through the diffuser by changing a direction of the fluid by approximately 90 degrees.

Aspect N is a pump of any previous or subsequent aspect, wherein the means for diverting forces the fluid into a helical shape toward the outlet of the pump.

Aspect O is a pump of any previous or subsequent aspect, wherein the means for diverting is a plurality of deflection structures integrated with the diffuser.

Aspect P is a pump for improved priming performance of a swimming pool or spa, the pump comprising at least one deflection structure configured to divert fluid flowing through a diffuser in a circular path into an axial path leading directly to an outlet of the pump, where the at least one deflection structure is a rib, a wall, a ramp, a projection, a curved surface, a twisted surface, or an extension.

Aspect Q is a pump of any previous or subsequent aspect, wherein the at least one deflection structure extends at least partially into a gap formed between an outer diameter of the diffuser and an inner diameter of a housing of the pump.

Aspect R is a pump of any previous or subsequent aspect, wherein the at least one deflection structure extends completely or nearly completely through the gap, thereby preventing the fluid from recirculating within the gap along the circular path.

Aspect S is a pump of any previous or subsequent aspect, wherein the at least one deflection structure is configured to divert the fluid moving through the diffuser by changing a direction of the fluid by approximately 90 degrees.

Aspect T is a pump of any previous or subsequent aspect, wherein the at least one deflection structure forces the fluid into a helical shape toward the outlet of the pump.

Aspect U is a pump of any previous or subsequent aspect, wherein the at least one deflection structure is integrated with the diffuser.

Aspect V is pump for improved priming performance of a swimming pool or spa, the pump comprising at least one deflection structure extending at least partially into a gap formed between an outer diameter of a diffuser and an inner diameter of a housing of the pump, the at least one deflection structure configured to modify a path of fluid flowing through the gap, and wherein the at least one deflection structure is on at least one of: an interior wall of the housing of the pump; a surface of a seal plate of the pump; a ring configured to couple with the diffuser; an impeller of the pump; or the diffuser.

Aspect W is a pump of any previous or subsequent aspect, wherein at least one deflection structure is configured to divert a majority of the fluid flowing through the gap from a circular path directly to an outlet of the pump.

Aspect X is a pump of any previous or subsequent aspect, wherein the at least one deflection structure extends completely or nearly completely through the gap, thereby preventing the fluid from recirculating within the gap along the circular path.

Aspect Y is a pump of any previous or subsequent aspect, wherein the at least one deflection structure is configured to modify the path of the fluid from a circular path to an axial path generally perpendicular to the circular path.

Aspect Z is a pump of any previous or subsequent aspect, where the at least one deflection structure is a rib, a wall, a ramp, a projection, a curved surface, a twisted surface, or an extension.

Aspect AA is a pump of any previous or subsequent aspect, wherein the at least one deflection structure is configured to modify the path of the fluid by changing a direction of the fluid by approximately 90 degrees.

Aspect BB is a pump of any previous or subsequent aspect, wherein the at least one deflection structure forces the fluid flowing through the gap out of a circular path and into a helical shape toward an outlet of the pump.

Aspect CC is a pump of any previous or subsequent aspect, wherein the at least deflection structure is integrated with the diffuser.

Aspect DD is a method of improving pump priming performance of a swimming pool or spa, the method comprising diverting fluid moving in a circular path through a diffuser of a pump by changing a direction of the fluid so the fluid flows in an axial path directly to an outlet of the pump instead of the circular path through the diffuser.

These examples are not intended to be mutually exclusive, exhaustive, or restrictive in any way, and the invention is not limited to these example embodiments but rather encompasses all possible modifications and variations and combinations within the scope of any claims ultimately drafted and issued in connection with the invention (and their equivalents). For avoidance of doubt, any combination of features not physically impossible or expressly identified as non-combinable herein may be within the scope of the invention.

Further, although Applicant has described devices and techniques for use with swimming pools and spas, persons skilled in the relevant field will recognize the present invention may be employed with any pump and is not limited to pumps used with swimming pools and spas. More specifically, the pumps disclosed herein can be used to route and distribute any source of water or other fluid. Finally, references to "pools" and "swimming pools" herein may also refer to spas and other water-containing vessels, ponds and other bodies of water, water features such as waterfalls and fountains, water removal or routing apparatuses (e.g., sump pumps), or any other usage involving a pump.

What is claimed is:

1. A pump for improved priming performance of a swimming pool or spa, the pump comprising:

a housing comprising an outlet;

a diffuser within the housing; and a diverter for diverting fluid moving through the diffuser from a circular path directly to the outlet of the housing of the pump, the diverter extending at least partially into a gap formed between an outermost diameter of the diffuser and an inner diameter of the housing of the pump.

2. The pump of claim 1, wherein the diverter extends at least partially into the gap such that the diverter diverts a majority of the fluid moving through the diffuser from the circular path to an axial path generally perpendicular to the circular path.

3. The pump of claim 1, wherein the diverter comprises at least one deflection structure that extends completely or nearly completely through the gap, thereby preventing the fluid from recirculating within the gap along the circular path.

4. The pump of claim 1, where the diverter is a projection with a curved face.

5. The pump of claim 1, wherein the diverter extends at least partially into the gap such that the diverter is configured to change a direction of the fluid by approximately 90 degrees.

6. The pump of claim 1, wherein the diverter extends at least partially into the gap such that the diverter is configured to force the fluid into a helical shape toward the outlet of the pump.

7. The pump of claim 1, wherein the diverter comprises a plurality of deflection structures integrated with the diffuser and extending outwards from the diffuser into the gap.

8. The pump of claim 1, wherein the diffuser comprises a plurality of vanes.

9. A pump for improved priming performance of a swimming pool or spa, the pump comprising:

at least one deflection structure configured to divert fluid flowing through a diffuser in a circular path into an axial path leading directly to an outlet of the pump, where the at least one deflection structure is a projection, and wherein the at least one deflection structure extends at least partially into a gap formed between an outermost diameter of the diffuser and an inner diameter of a housing of the pump that houses the diffuser.

10. The pump of claim 9, wherein the at least one deflection structure extends completely or nearly completely through the gap, thereby preventing the fluid from recirculating within the gap along the circular path.

11. The pump of claim 9, wherein the at least one deflection structure is configured to divert the fluid moving through the diffuser by changing a direction of the fluid by approximately 90 degrees.

12. The pump of claim 9, wherein the at least one deflection structure forces the fluid into a helical shape toward the outlet of the pump.

13. The pump of claim 9, wherein the at least one deflection structure is integrated with the diffuser.

14. The pump of claim 9, wherein the diffuser comprises a plurality of vanes.

15. A pump for improved priming performance of a swimming pool or spa, the pump comprising:

at least one deflection structure extending at least partially into a gap formed between an outermost diameter of a diffuser and an inner diameter of a housing of the pump that houses the diffuser, the at least one deflection structure configured to modify a path of fluid flowing through the gap, and wherein the at least one deflection structure is on at least one of: an interior wall of the housing of the pump; a surface of a seal plate of the pump; a ring configured to couple with the diffuser; an impeller of the pump; or the diffuser.

16. The pump of claim 15, wherein the at least one deflection structure is configured to divert a majority of the fluid flowing through the gap from a circular path directly to an outlet of the pump.

17. The pump of claim 16, wherein the at least one deflection structure extends completely or nearly completely through the gap, thereby preventing the fluid from recirculating within the gap along the circular path.

18. The pump of claim 15, wherein the at least one deflection structure is configured to modify the path of the fluid from a circular path to an axial path generally perpendicular to the circular path.

19. The pump of claim 15, where the at least one deflection structure is a projection with a curved face.

20. The pump of claim 15, wherein the at least one deflection structure is configured to modify the path of the fluid by changing a direction of the fluid by approximately 90 degrees.

21. The pump of claim 15, wherein the at least one deflection structure forces the fluid flowing through the gap out of a circular path and into a helical shape toward an outlet of the pump.

22. The pump of claim 15, wherein the at least one deflection structure is integrated with the diffuser.

23. A method of improving pump priming performance of a swimming pool or spa, the method comprising diverting fluid moving in a circular path through a diffuser of a pump by changing a direction of the fluid using at least one deflection structure extending at least partially into a gap formed between an outermost diameter of the diffuser and an inner diameter of a housing of the pump that houses the diffuser so the fluid flows in an axial path directly to an outlet of the pump instead of the circular path through the diffuser.

* * * * *